US006096963A

United States Patent [19]

Hirano

[11] Patent Number: 6,096,963

[45] Date of Patent: Aug. 1, 2000

[54] TONE SYNTHESIZING APPARATUS AND METHOD BASED ON ENSEMBLE OF ARITHMETIC PROCESSOR AND DEDICATED TONE GENERATOR DEVICE

[75] Inventor: Masashi Hirano, Hamamatsu, Japan

[73] Assignee: Yamaha Corporation, Hamamatsu, Japan

[21] Appl. No.: 09/189,670

[22] Filed: Nov. 11, 1998

Related U.S. Application Data

[63] Continuation of application No. 08/807,416, Feb. 28, 1997, Pat. No. 5,864,082.

[30] Foreign Application Priority Data

Mar. 5, 1996 [JP] Japan ..... 8-078398

[51] Int. Cl.[7] ..... G10H 5/02

[52] U.S. Cl. ..... 84/659; 84/645

[58] Field of Search ..... 84/600–602, 645, 84/659, 622

[56] References Cited

U.S. PATENT DOCUMENTS 4,373,416 2/1983 Endo et al. .
5,200,564 4/1993 Usami et al. .
5,283,386 2/1994 Akutsu et al. ..... 84/603
5,319,151 6/1994 Shiba et al. ..... 84/622 X
5,448,009 9/1995 Kudo ..... 84/622 X
5,596,159 1/1997 O'Connell ..... 84/622
5,604,324 2/1997 Kubota et al. .
5,625,158 4/1997 Ichiki ..... 84/603
5,726,371 3/1998 Shiba et al. ..... 84/603

*Primary Examiner*—Jeffrey Donels
*Attorney, Agent, or Firm*—Morrison & Foerster

[57] ABSTRACT

To allow a general-purpose processor and dedicated tone generator device to execute an ensemble with their tone generating timing properly matched with each other, tone synthesizing processing based on performance information is assigned to either the general-purpose processor or the dedicated tone generator device. The general-purpose processor, after completion of the tone synthesizing processing thereby, performs control to cause the dedicated tone generator device to execute the tone synthesizing processing assigned to the device. By the time the dedicated tone generator device starts the tone synthesizing processing, a time necessary for the general-purpose processor to execute the processing has already passed away, so that tones synthesized by the processor and tone generator device can be generated at properly matched timing.

23 Claims, 12 Drawing Sheets

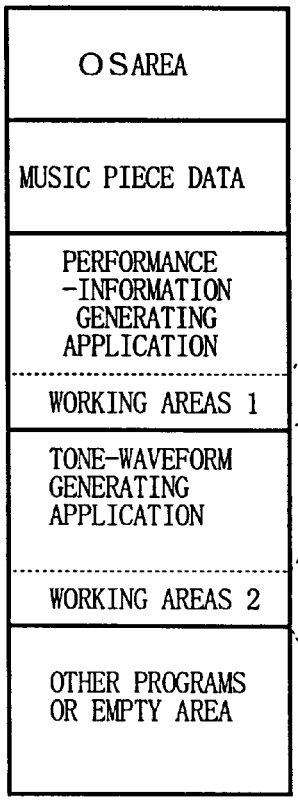
FIG. 2A
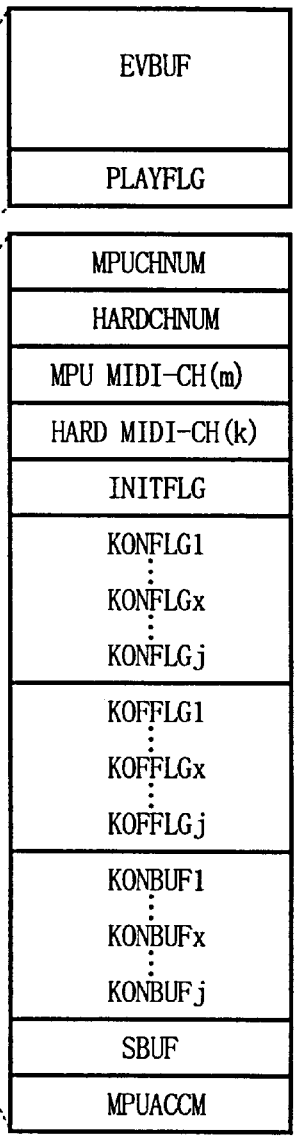
FIG. 2B
FIG. 3A
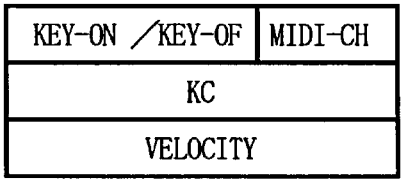
(KEY EVENT)
FIG. 3B
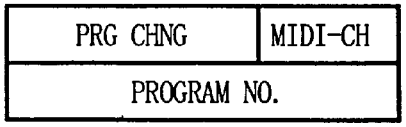
(PROGRAM CHANGE EVENT)

TONE SYNTHESIZING APPARATUS AND METHOD BASED ON ENSEMBLE OF ARITHMETIC PROCESSOR AND DEDICATED TONE GENERATOR DEVICE

RELATED APPLICATION

This application is a continuation of application Ser. No. 08/807,416, filed Feb. 26, 1997, now issued as U.S. Pat. No. 5,864,082 on Jan. 26, 1999.

BACKGROUND OF THE INVENTION

The present invention relates generally to the field of synthesizing a tone waveform, and more particularly to a tone synthesizing apparatus and method using an arithmetic processor such as a CPU and a dedicated tone generator device such as a tone generator LSI circuit.

With recent improvements in arithmetic processing capabilities of CPUs, tone synthesizing systems have been developed which use a CPU to execute a program descriptive of processing for generating performance information (e.g., a sequence program descriptive of automatic performance processing) as well as a program descriptive of tone synthesizing processing (based, for example, on the well-known waveform memory or FM technique) responsive of the performance information generated by the performance information generating processing. These tone synthesizing systems have the advantage that they can synthesize a tone waveform using compact and low-cost circuity without requiring a particular dedicated tone generator device such as a tone generator LSI circuit. Thus, the tone synthesizing systems have been widely used today not only in CPU-equipped electronic musical instruments and computer music systems provided with a personal computer but also in CPU-equipped karaoke devices, game machines, teaching equipment, etc.

Unlike the dedicated tone generator device, the CPU must execute various other processing than the tone synthesizing processing, such as those for an OS (operating system) and other application software. For this reason, an undesirable time delay tends to occur due to the fact that initiation of the tone synthesizing processing has to be delayed, even when performance information is supplied, if execution of other processing is under way at that time, or that the tone synthesizing processing has to be temporarily stopped in order to execute an interrupt process during execution of the processing. To provide a solution to the problem, more sophisticated tone synthesizing systems have been proposed, in which a given allowance time sufficiently longer than an expected delay time is preset as an extra period for the tone synthesizing processing so that transfer of tone waveform data to a sound system is initiated upon lapse of this allowance time; thus, in this case, it is only necessary for the CPU to complete synthesis of a predetermined number of tone waveform samples within the sufficiently long allowance time. With such an arrangement, some of the sophisticated tone synthesizing systems are capable of executing performance of a music piece or the like at uniform tone generation timing irrespective of different delay times occurring in the tone synthesizing processing based on individual performance information.

As mentioned above, the tone synthesizing systems which have their CPUs execute the tone synthesizing processing have the superior advantage that a tone waveform can be synthesized with compact and low-cost circuity without requiring a particular dedicated tone generator device such as a tone generator LSI circuit. However, the number of simultaneously generatable tones and tone colors that can be synthesized by the CPU alone may be substantially limited depending on the CPU's arithmetic processing capability, particular specifications of the tone synthesizing processing program, etc. For this reason, it is desirable to further increase the number of simultaneously generatable tones and variations of tone colors in cases where such a tone synthesizing system is employed. One approach to realize such a performance may be to additionally provide a separate dedicated tone generator device so that both the CPU and the dedicated tone generator device perform a same music piece (i.e., ensemble) by executing the tone synthesizing processing together.

SUMMARY OF THE INVENTION

It is an object of the present invention to provide a tone synthesizing apparatus and method which are suitable for allowing both a general-purpose arithmetic processor such as a CPU and a dedicated tone generator device such as a tone generator LSI circuit to perform an ensemble.

A tone synthesizing apparatus according to a first aspect of the present invention generally comprises a general-purpose processor, a dedicated tone generating device which executes tone synthesizing processing, a device adapted to supply performance information and a determining device that, makes a determination as to which of the general-purpose processor and dedicated tone generating device should execute the tone synthesizing processing, which tone synthesizing is based on performance information supplied by said adapted device. The general-purpose processor executes first tone synthesizing processing determined by the determining device to be executed by the general-purpose processor, and a process for, after completion of the first tone synthesizing processing, instructing the dedicated tone generating device to execute second tone synthesizing processing determined by the determining device to be executed by the dedicated tone generating device.

Further, a tone synthesizing method according to a first aspect of the present invention comprises a first step of, making a determination as to which of a general-purpose processor and dedicated tone generating device should execute the tone synthesizing processing, which tone synthesizing processing is based on performance information supplied by a device adapted to supply performance information, a second step of causing the general-purpose processor to execute the tone synthesizing processing determined by the first step to be executed by the general-purpose processor, and a third step of, after completion of the second step, causing the dedicated tone generating device to execute the tone synthesizing processing determined by the first step to be executed by the dedicated tone generating device, under control of the general-purpose processor.

In the tone synthesizing apparatus and method according to the first aspect of the invention, tone synthesizing processing based on supplied performance information is assigned to either the general-purpose processor or the dedicated tone generator device. First, the general-purpose processor executes the tone synthesizing processing assigned thereto, which may involve a significant time delay. To deal with such a time delay, the above-discussed approach is sometimes employed to make it only necessary that the general-purpose processor should complete the tone synthesizing processing before lapse of a given allowance time preset to be considerably longer than an expected delay time. After completion of the tone synthesizing processing by the general-purpose processor (or once the given allowance time has elapsed if it is preset), the dedicated tone generator device executes the tone synthesizing processing assigned thereto, under control of the general-purpose processor. The tone synthesizing processing is completed rapidly without involving a time delay as encountered in the general-purpose processor.

As noted above, the thus-arranged tone synthesizing apparatus and method perform control such that the dedicated tone generating device conducts tone synthesizing processing after the general-purpose processor has completed tone synthesizing processing. Thus, by the time the dedicated tone generating device initiates the tone synthesizing processing, the time necessary for the general-purpose processor to execute the tone synthesizing processing (or the given allowance time if it is preset) has already passed away. Consequently, irrespective of the time delay in the tone synthesizing processing by the processor, generation timing of tones synthesized by the general-purpose processor and tones synthesized by the dedicated tone generating device can always properly agree with each other. With such an arrangement, the present invention permits both the general-purpose processor and the dedicated tone generating device to execute an ensemble performance of a same music piece or the like.

A tone synthesizing apparatus according to a second aspect of the present invention also generally comprises a general-purpose processor, a dedicated tone generating device which executes tone synthesizing processing, and a determining device that, makes a determination as to which of the general-purpose processor and dedicated tone generating device should execute the tone synthesizing processing, which tone synthesizing processing is based on performance information supplied by a device adapted to supply performance information. The general-purpose processor executes: a first allocating process for allocating one or more first tone generating channels of channel numbers within a predetermined range to the general-purpose processor, as tone generating channels to execute first tone synthesizing processing determined by the determining device to be executed by the general-purpose processor; a second allocating process for allocating one or more second tone generating channels of channel numbers different from the channel numbers for the first tone generating channels, as tone generating channels to execute second tone synthesizing processing determined by the determining device to be executed by the dedicated tone generating device; tone synthesizing processing for the first tone generating channels; and a process for, after completion of the first tone synthesizing processing, instructing the dedicated tone generating device to execute second tone synthesizing processing for the second tone generating channels.

Further, a tone synthesizing method according to a second aspect of the present invention comprises: a first step of, making a determination as to which of the general-purpose processor and dedicated tone generating device should execute the tone synthesizing processing, which tone synthesizing processing is based on performance information supplied by a device adapted to supply performance information; a second step of causing the general-purpose processor to execute a process for allocating one or more first tone generating channels of channel numbers within a predetermined range to the general-purpose processor, as tone generating channels to execute first tone synthesizing processing determined by the first step to be executed by the general-purpose processor; a third step of causing the general-purpose processor to execute a process for allocating one or more second tone generating channels of channel numbers different from the channel numbers for the first tone generating channels, as tone generating channels to execute second tone synthesizing processing determined by the first step to be executed by the dedicated tone generating device; a fourth step of instructing the general-purpose processor to execute the first tone synthesizing processing for the first tone generating channels; and a fifth step of, after completion of the fourth step, causing the dedicated tone generating device to execute second tone synthesizing processing for the second tone generating channels, under control of the general-purpose processor.

In the tone synthesizing apparatus and method according to the second aspect as well, tone synthesizing processing based on supplied performance information is assigned to either the general-purpose processor or the dedicated tone generator device. The general-purpose processor allocates one or more first tone generating channels of channel numbers within a predetermined range to itself, as tone generating channels to execute the tone synthesizing processing determined to be executed by the processor, and it also allocates one or more second tone generating channels of channel numbers different from the channel numbers for the first tone generating channels to the dedicated tone generating device, as tone generating channels to execute the tone synthesizing processing determined to be executed by the tone generating device. First, the general-purpose processor executes the tone synthesizing processing for the first tone generating channels, and then, after completion of the tone synthesizing processing by the general-purpose processor, the dedicated tone generator device executes the tone synthesizing processing for the second tone generating channels under control of the general-purpose processor.

Namely, in the tone synthesizing apparatus and method according to the second aspect of the invention, the general-purpose processor allocates different channel numbers to the dedicated tone generating device and itself. Then, after completion of the tone synthesizing processing for the tone generating channels of channel numbers allocated thereto, the general-purpose processor instructs the dedicated tone generating device to execute the tone synthesizing processing for the tone generating channels of unique channel numbers allocated thereto. Through such channel number management, the dedicated tone generating device is allowed to execute its tone synthesizing processing after the general-purpose processor has completed its tone synthesizing processing. By virtue of this, generation timing of tones synthesized by the general-purpose processor and tones synthesized by the dedicated tone generating device can always properly agree with each other, thereby permitting an ensemble performance by the general-purpose processor and dedicated tone generating device.

BRIEF DESCRIPTION OF THE DRAWINGS

For better understanding of the above and other features of the present invention, the preferred embodiments of the invention will be described in greater detail below with reference to the accompanying drawings, in which:

FIGS. 2A and 2B are diagrams showing examples of various storage areas in a RAM of FIG. 1;

FIGS. 3A and 3B are diagrams showing examples of events occurring from execution of performance information generating application software;

DETAILED DESCRIPTION OF THE PREFERRED EMBODIMENTS

Figure 1:
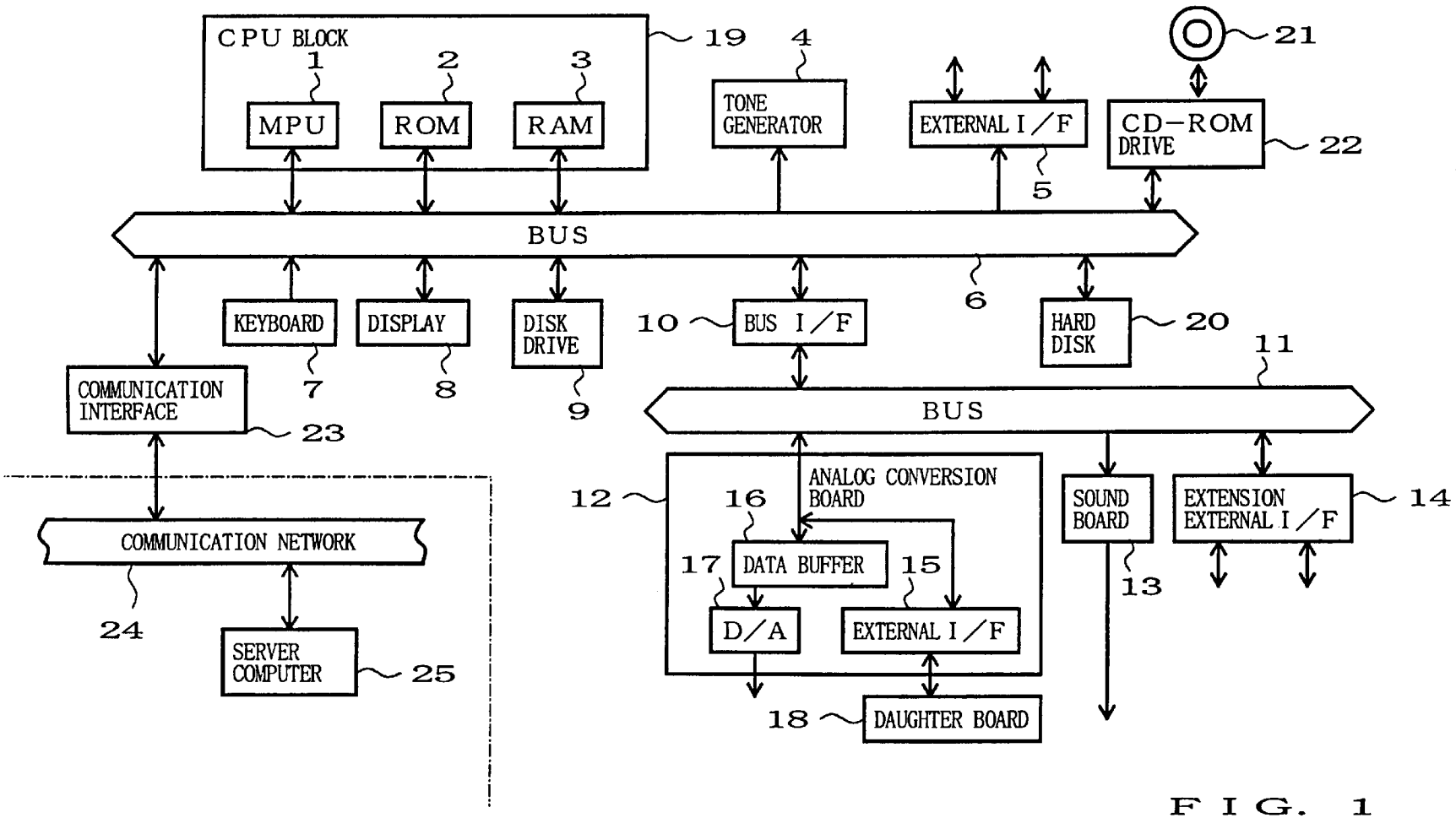
FIG. 1 is a block diagram showing a general configuration of a computer music system according to an embodiment of the present invention.

FIG. 1 is a block diagram showing a general configuration of a computer music system using a personal computer according to an embodiment of the present invention. MPU 1 (microprocessor unit) in a CPU block 19 of the personal computer is connected, via a bus (i.e., a combination of address, control and data buses) 6, with a ROM 2, a RAM 3, a tone generator (tone generator LSI circuit) 4, an external interface 5, a keyboard 7, a display 8 and a disk drive 9. Via the bus 6, bus interface 10 and bus for extension slot 11, the MPU 1 is also connected with an analog conversion board 12, a sound board (extension board on which the tone generator LSI circuit is mounted) 13, and an extension external interface 14.

To the tone generator (tone generator LSI circuit) 4 and sound board 13 are connected respective sound systems (not shown) via D/A (digital-to-analog) converters (DAC: not shown). To the analog conversion board 12 is connected, via an external interface 15, a daughter board 18 which is a sound board connecting to the conversion board 12 functioning as a mother board. For example, on the daughter board 18, there are mounted a tone generating LSI (in some cases, a memory for storing tone parameters and waveform data is also mounted) and a sound effect processing LSI; in response to an instruction from the MPU 1 or the like, the daughter board 18 executes various operations to generate and supply tone waveform data and impart various effects to tones.

The analog conversion board 12 includes a data buffer 16 for mixing together tone waveform data supplied from the daughter board 18 or from a particular component, other than the daughter board 18, via the extension slot bus 11, and a D/A converter (DAC) 17 for converting into analog representation the tone waveform data mixed via the data buffer 16. Another sound system (not shown) is connected to the D/A converter 17 as well. External interface 5 and extension external interface 14 each include MIDI terminals to which is connected a MIDI instrument (not shown) such as a sequencer, performance operator or tone generator device.

Thus, according to this embodiment, the computer music system includes a plurality of dedicated tone generator devices: the tone generator 4 provided within the computer; the analog conversion board 12 (and daughter board 18) attached to the extension slot; and the sound board 13. These dedicated tone generator devices in the computer music system will hereinafter be called "hardware tone generators".

To the disk drive 9 is attached a disk-shaped recording medium which has prestored therein a plurality of sorts of music piece data, performance-information generating application software that is descriptive of processing to generate performance information in accordance with the music piece data (e.g., sequence software), tone-waveform generating application software that is descriptive of tone synthesizing processing based on performance information generated by the performance-information generating processing and other application software.

The programs to be executed by the MPU 1 may be prestored in the ROM 2 rather than on the hard disk 20, and there may be stored various other data than the waveform data. By loading any of the programs from the hard disk 20 or ROM 2 into the RAM 3, the MPU 1 can execute the program. This greatly facilitates version-up, addition, etc. of an operating program. A CD-ROM (compact disk) 21 may be used as a removably-attachable external recording medium for recording various data and an optional operating program. Such an operating program and data stored in the CD-ROM 21 can be read out by means of a CD-ROM drive 22 to be then transferred for storage on the hard disk 20. Such arrangements facilitate installation and version-up of the operating program. The removably-attachable external recording medium may be other than the CD-ROM, such as a floppy disk and magneto optical disk (MO).

A communication interface 23 may be connected to the bus 6 so that the computer music system can be connected via the interface 23 to a communication network 24 such as a LAN (local area network), internet and telephone line network and can also be connected to an appropriate sever computer 25 via the communication network 24. Thus, where the operating program and various data are not stored on the hard disk 20, these operating program and data can be received from the server computer 25 and downloaded onto the hard disk 20. In such a case, the computer music system, i.e., a "client", sends a command requesting the server computer 25 to download the operating program and various data by way of the communication interface 23 and communication network 24. In response to the command from the computer music system, the server computer 25 delivers the requested operating program and data to the system via the communication network 24. The computer music system completes the necessary downloading by receiving the operating program and data via the communication network 24 and storing these onto the hard disk 20.

FIGS. 2A and 2B are diagrams showing examples of various storage areas in the RAM 3. As shown in FIG. 2A, the RAM 3 includes an OS area for storing an operating system (OS), and areas for storing music piece data, performance-information generating application software and tone-waveform generating application software, respectively, loaded from the disk recording medium. The latter areas contain working areas WA1 for storing various data created during execution of the performance-information generating application software, and working areas WA2 for storing various data created during execution of the tone-waveform generating application software. The RAM 3 includes another area for storing other programs, or an empty area.

As shown in FIG. 2B, the working areas WA1 include an event buffer region EVBUF for storing various events generated by execution of the performance-information generating application software, and a region for storing play flag PLAYFLG. The play flag PLAYFLG is set to a value "1" when the keyboard 7 is operated to select an automatic performance mode for executing the tone-waveform generating application software on the basis of an event generated by execution of the performance-information generating application software. The play flag PLAYFLG is set to a value "0" when the keyboard 7 is operated to select a mode for executing the tone-waveform generating application software on the basis of an event supplied from an external sequencer MIDI-connected with the present music system or an event generated by a user working an external performance operator MIDI-connected with the present computer music system, rather than an event generated by execution of the performance-information generating application software.

As further shown in FIG. 2B, the working areas WA2 include the following storage areas:

(1) Area for storing data "MPUCHNUM" indicative of the number of tone generating channels that can be allocated to the MPU 1;

(2) Area for storing data "HARDCHNUM" indicative of the number of tone generating channels that can be allocated to the hardware tone generators provided within the computer music system;

(3) Area for storing data "MPUMIDI-CH(m)" indicative of "m" MIDI channels (from among a total of 16 MIDI channels) for receiving performance information on which is based the tone synthesizing processing assigned to the MPU 1 (where "m" is one of 16 natural numbers from "1" to "16");

(4) Area for storing data "HARDMIDI-CH(k)" indicative of "k" MIDI channels for receiving performance information on which is based the tone synthesizing processing assigned to the hardware tone generators provided within the music system (where "k" is one of 16 natural numbers from "1" to "16" which satisfies a condition of $m+k \leqq 16$);

(5) Area for storing initial flag INITFLG indicating whether or not the computer music piece is currently in a mode for setting various conditions on which is based the tone synthesizing processing (i.e., setting mode);

(6) Area for storing key-on flags KONFLG1–KONFLGj each indicating whether or not a key-on event has occurred for any of the tone generating channels of channel numbers CH1–CHj (where j≧"MPUCHNUM"+"HARDCHNUM");

(7) Area for storing key-off flags KOFFLG1–KOFFLGj each indicating whether or not a key-off event has occurred for any of the above-mentioned tone generating channels of channel numbers CH1–CHJ;

(8) Area of key-on buffers KONBUF1–KONBUFj each indicating whether or not the tone synthesizing processing is under way;

(9) Area of sound buffers SBUF1–SBUF which are provided in corresponding relations to the tone generating channels "MPUCHNUM" that can be allocated to the MPU 1; and

(10) Area for storing an accumulation of tone waveform data MPUACCM in the individual sound buffers.

Because the above-mentioned number "MPUCHNUM" of tone generating channels that can be allocated to the MPU 1 is limited due to various factors such as the arithmetic processing speed of the MPU 1 and particular specifications of the tone waveform generating application software, it may be designated uniformly by the MPU 1 on the basis of these factors. In another alternative, the number "MPUCHNUM" may be optionally set, within the limit determined by these factors, by a user's operating the keyboard 7.

Further, because the above-mentioned number "HARDCHNUM" of tone generating channels that can be allocated to the hardware tone generators is limited due to various factors such as the total number and particular specifications of the hardware tone generators, it may be designated uniformly by the MPU 1 on the basis of these factors. In another alternative, the number "HARDCHNUM" may be optionally set, within the limit determined by these factors, by the user operating the keyboard 7.

The channels "MPUMIDI-CH(m)" and "HARDMIDI-CH(k)" may be preset in application software or may be optionally set through a user's operation of the keyboard 7. The above-mentioned initial flag INITFLG is set to "0" when the setting mode is selected through a user's operation of the keyboard 7, but set to "1" when termination of the setting mode is selected through a user's operation of the keyboard 7.

Of the "j" channel numbers corresponding to the above-mentioned key-on flags KONFLG1–KONFLGj, key-off flags KOFFLG1–KOFFLGj and key-on buffers KONBUF1–KONBUFj, the first to "MPUCHNUM"th channel numbers are managed by the MPU 1 as those that should correspond to the tone generating channels allocated to the MPU 1, and the "MPUCHNUM+1"th to "MPUCHNUM+HARDCHNUM"th channel numbers are managed by the MPU 1 as those that should correspond to the tone generating channels allocated to the hardware tone generators. Namely, as will be later described in detail, when the MPU 1 allocates the tone generating channels thereto, it controls set values of the key-on flags, key-off flags and key-on buffers corresponding to the channels numbers within a range determined by the number "MPUCHNUM"; when the MPU 1 allocates the tone generating channels to the hardware tone generators, it controls set values of the key-on flags, key-off flags and key-on buffers corresponding to the channels numbers within a range from the channel number "MPUCHNUM+1" to the channel number "MPUCHNUM+HARDCHNUM".

FIGS. 3A and 3B show examples of events occurring from execution of the performance-information generating application software. Key event of FIG. 3A, occurring when a key-on or key-off event occurs, includes data "KEYON/KEYOFF" indicating whether the key event is a key-on or key-off event, data "MIDI-CH" indicating a MIDI channel associated with the key-on or key-off event, key code data "KC", and key touch data "VELOCITY". Program change event of FIG. 3B, occurring when a tone color change has taken place for the MIDI channel in question after the key-on event, includes data "PRGCHNG" indicating that there has a tone color change, data "MIDI-CH" indicating a MIDI channel associated with the tone color change, and data "PROGRAMNo." indicative of a resultant changed (i.e., new) tone color. These events are written in the event buffer EVBUF shown in block (b) of FIG. 2.

Figure 4:
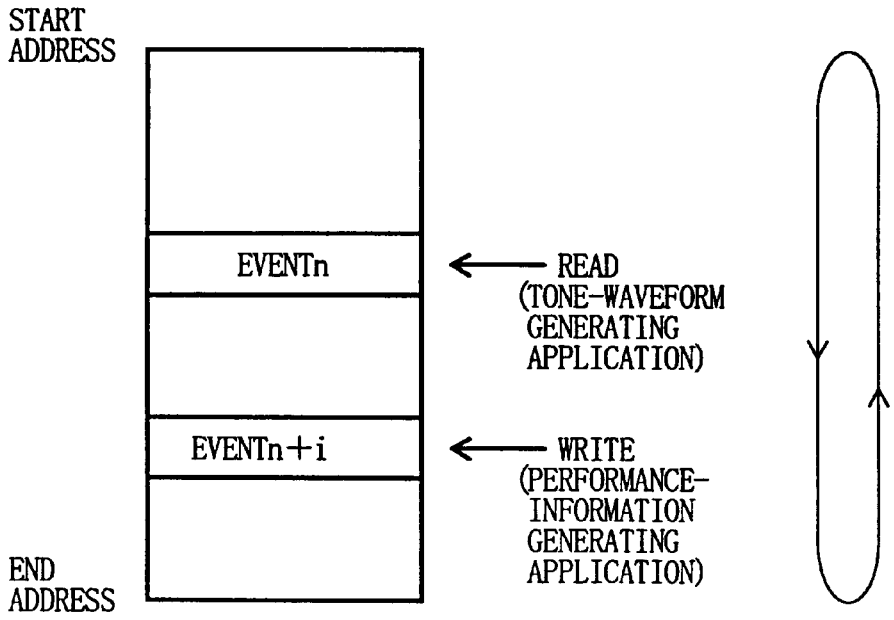
FIG. 4 is a diagram explanatory of exemplary operation to write and read an event to and from the event buffer.

FIG. 4 is explanatory of exemplary operation to write and read an event to and from the event buffer EVBUF. In this example, the event buffer EVBUF is constructed as a ring buffer, where a write pointer WRITE cyclically designates addresses in the buffer EVBUF from the start address to the end address and a read pointer READ follows the write pointer to cyclically designate the addresses in the buffer EVBUF. The performance-information generating application software writes an event into the address that is designated by the write pointer WRITE at the time of the event occurrence. The tone waveform generating application software sequentially reads out the event from the address designated by the read pointer READ, so as to execute the tone synthesizing processing corresponding to the read-out event. Therefore, the event buffer EVBUF functions equivalently to a FIFO (first-in-first-out) buffer.

Next, an example of the tone synthesizing processing executed in the computer music system will be described with reference to FIGS. 5 and subsequent figures.

Figure 5:
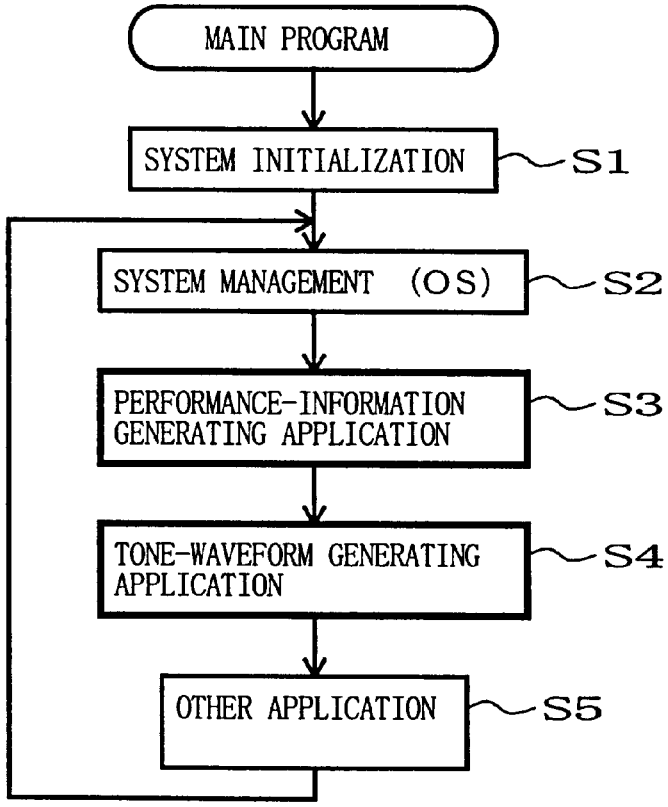
FIG. 5 is a flowchart outlining a main program executed by a MPU.

FIG. 5 is a flowchart outlining a main program executed by the MPU 1. First, the computer music system is initialized at step S1, after which at step S2, the main program conducts a system management based on execution of the operating system (OS): the music piece data in the disk-shaped recording medium attached to the disk drive 9, performance-information generating application software, tone-waveform generating application software and other application software are loaded into the RAM 3 through this system management. The system management (step S2), processing of the performance-information generating application software (step S3), processing of the tone-waveform generating application software (step S4) and processing of the other application software (step S5) are executed repetitively in a steady loop.

However, the operations of steps S2 to S5 are not necessarily executed in the order shown in FIG. 5. Namely, these operations are initiated at timing when their respective triggering conditions (e.g., generation of an internal interrupt signal, generation of an external interrupt signal responsive to an operation on the operation panel, generation of an external interrupt signal from a timer, etc.) are satisfied. If, during execution of particular processing, the triggering condition of other processing having higher priority than the particular processing is met, then the particular processing will be interrupted to execute the other processing and then the particular processing will be resumed upon completion of the other processing.

Figure 6:
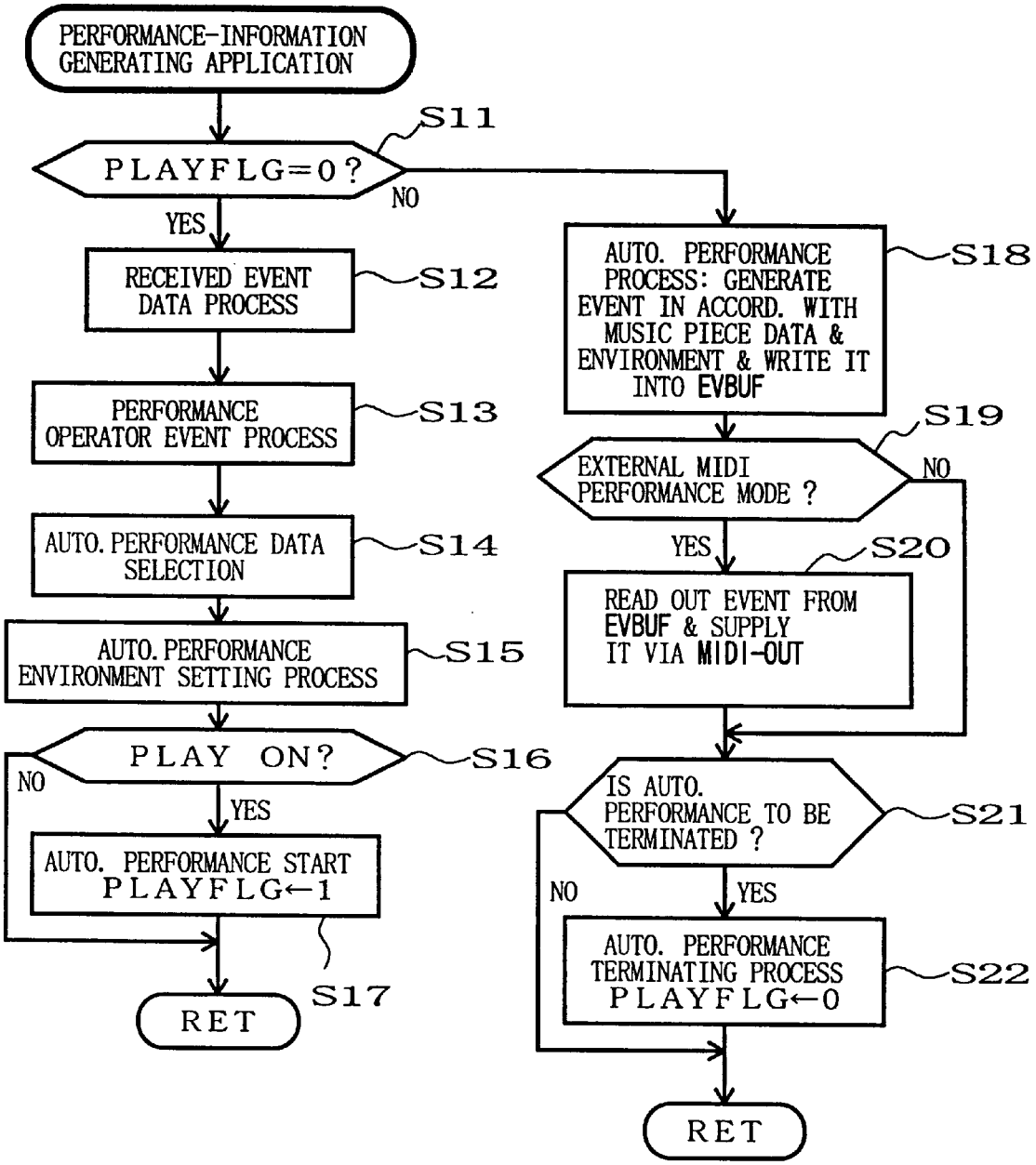
FIG. 6 is a flowchart showing an example of processing of performance-information generating application software shown in FIG. 5.

FIG. 6 is a flowchart showing an example of the performance-information generating application software processing. First, it is determined at step S11 whether or not the value of the play flag PLAYFLG (block (b) of FIG. 2) currently stored in working area WA1 is "0", i.e., whether or not the mode is currently selected for executing the tone-waveform generating application software on the basis of an event supplied from the external sequencer or supplied in response to actuation of the external performance operator.

If answered in the affirmative at step S11, then the program conducts processes for receiving the events from the external sequencer and external performance operator at steps S12 and S13, respectively. After this, the program conducts an automatic performance data selection process for selecting one of a plurality of music piece data groups or sorts (block (a) of FIG. 2) at step S14, as well as an automatic performance environment setting process for setting a performance environment for the selected music piece data group at step S15. At next step S16, a determination is made as to whether or not the automatic performance mode has been selected through a user's operation of the keyboard 7. If answered in the affirmative at step S16, the program goes to step S17 to set the play flag PLAYFLAG to a value "1" and then returns; if answered in the negative at step S16, the program returns without conducting the operation of step S17.

If, on the other hand, a "NO" determination results (i.e, when the value of the play flag PLAYFLAG has turned into "1" due to the operation of step S17) at step S11, the program goes from step S11 to step S18 in order to execute an automatic performance process. In this automatic performance process, a key event or program change event (FIG. 3) is generated in accordance with the music data selected at step S14 and the performance environment set at step S15, and the generated event is sequentially written into the event buffer EVBUF in the manner as shown by way of example in FIG. 4.

At next step S19, a determination is made as to whether or not an external MIDI performance mode is currently selected through operation of the keyboard 7 for causing only the external tone generator device, MIDI-connected to the present music system, to execute the tone synthesizing processing without the music system itself executing the tone synthesizing processing. If answered in the negative at step S19, the program jumps to step S21, while if answered in the affirmative, the program proceeds to step S20 to read out an event (FIG. 3) from the event buffer EVBUF (block (b) of FIG. 2) and supply the read-out event to the external tone generator device via a MIDI output terminal of the external interface 5 or extension external interface 14. Thus, tone synthesizing processing based on the event generated by the automatic performance process at step S18 is effected only by the external tone generator device. After step S20, the program proceeds to step S21.

At step S21, it is determined whether or not termination of the automatic performance mode has been selected via operation of the keyboard 7. With a negative answer, the program returns, while with an affirmative answer, the program proceeds to step S22 in order to set the play flag PLAYFLG to "0" and returns.

As another example of the performance-information generating application software processing, the operations of steps S12 and S13 of FIG. 6 may be omitted so that the tone-waveform generating application software processing is conducted only on the basis of an event occurring from the execution of the performance-information generating application software. As still another example, the operations of steps S12 and S13 of FIG. 6 may be executed prior to step S11 so that the tone-waveform generating application software processing is always conducted on the basis of both an event supplied from the external sequencer or via actuation of the external performance operator and an event occurring from execution of the performance-information generating application software processing.

Figure 7:
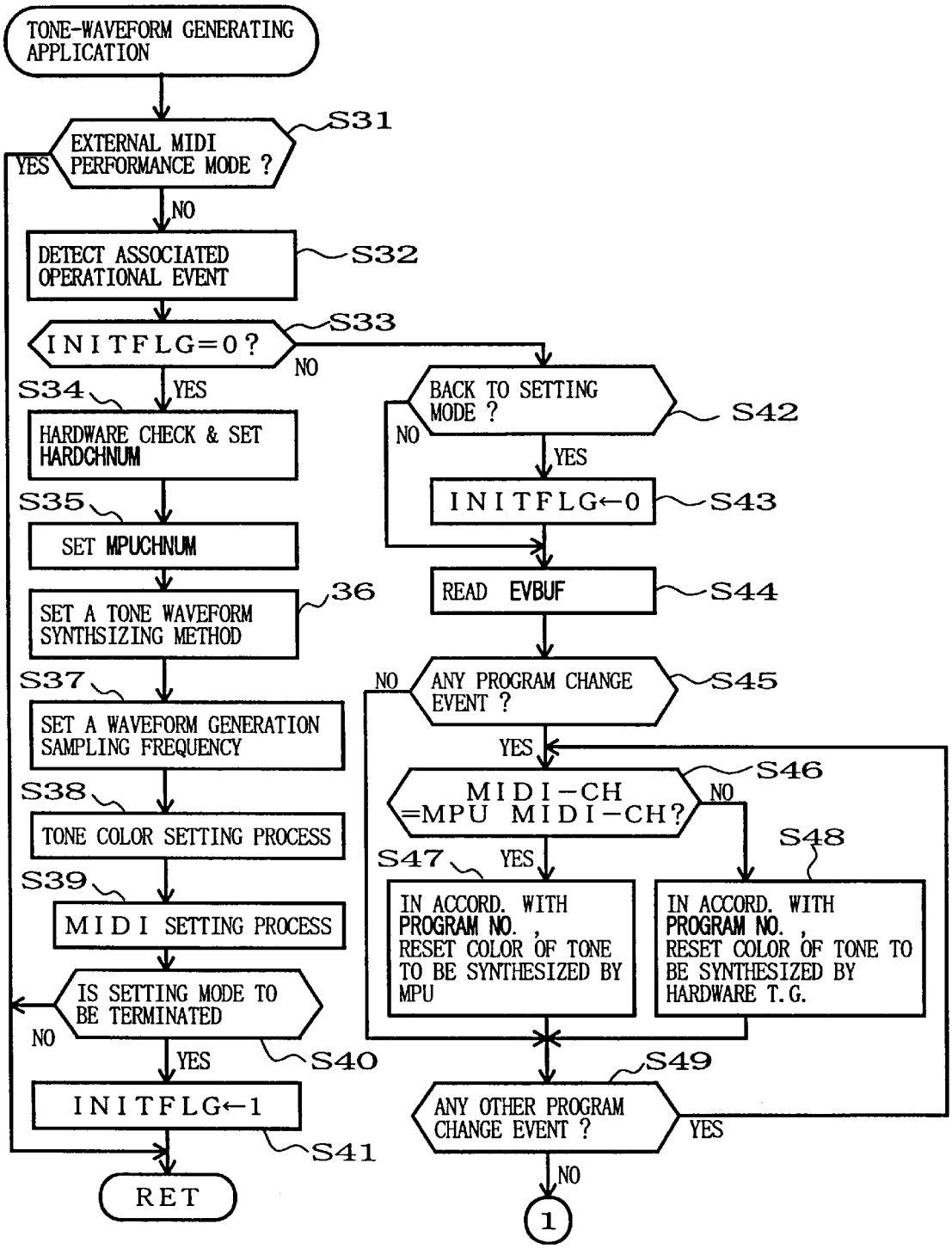
FIG. 7 is a flowchart showing an example of a portion of processing of tone-waveform generating application software shown in FIG. 5.

FIG. 7 is a flowchart showing an example of the tone-waveform generating application software processing at step S4 of FIG. 5. First, similarly to step S19, a determination is made, at step S31, as to whether or not the external MIDI performance mode is currently selected through operation of the keyboard 7. If answered in the affirmative, the program immediately returns. In this case, the tone synthesizing processing based on the event generated by the performance-information generating application software processing is effected only by the external tone generator device. If answered in the negative at step S31, the program proceeds to step S32 to detect various events on the keyboard 7 associated with tone synthesizing processing. At next step S33, a determination is made as to whether or not the initial flag INITFLG (block (b) of FIG. 2) is at "0", i,e., whether or not the setting mode is currently selected.

If answered in the affirmative at step S33, the program checks the hardware tone generators provided in the music system and sets the number "HARDCHNUM" (block (b) of FIG. 2) in the working area WA2 on the basis of the number, specifications of the hardware tone generators, etc. (alternatively, the number "HARDCHNUM" may be set at step S34 on the basis of operation of the keyboard 7). At next step S35, the number "MPUCHNUM" (block (b) of FIG. 2) in the working area WA2 is set on the basis of the arithmetic processing speed of the MPU 1 (alternatively, the number "MPUCHNUM" may be set at step S35 on the basis of operation of the keyboard 7).

After step S35, the program sets a method for synthesizing tones (e.g., waveform memory or FM synthesis method) in the MPU 1 at step S36 and sets a sampling frequency at which the MPU 1 synthesizes a tone waveform at step S37. The program further sets tone colors for the tone synthesizing processing executed by the MPU 1 and hardware tone generator at step S37 and conducts a MIDI setting process at step S39 for relating the tone colors set at step S38 to "MPUMIDI-CH(m)" or "HARDMINI-CH(k)" (block (b) of FIG. 2). Note that the MPU sampling frequency to be set at step S37 may coincide with a sampling frequency at which the hardware tone generator synthesizes a tone waveform, or may be greater than the hardware tone generator's sampling frequency to synthesize a tone waveform so that the number "MPUCHNUM" is set to a relatively great value. If the MPU sampling frequency is set to be lower than the hardware tone generator's sampling frequency, it is only necessary that the tone waveform synthesized by the hardware tone generator be set to coincide with the number of samples by interpolating between the tone waveform data after the tone waveform synthesis by the MPU 1.

At next step S40, a determination is made as to whether or not termination of the setting mode has been instructed by operation of the keyboard 7. If answered in the negative, the program returns immediately; otherwise, the program returns after setting the initial flag INITFLG to "1".

If a negative determination results at step S33 (i.e., if the initial flag INITFLG has been set to "1" by way of the operation, of step S40), the program goes to step S42 in order to further determine whether or not a selection has been made via operation of the keyboard 7 to go back to the setting mode. With a negative determination, the program jumps to step S44, while with an affirmative determination, the program proceeds to step S43 to set the initial flag INIFLG again to "0" before going to step S44.

At step S44, events are sequentially read out from the event buffer EVBUF (block (b) of FIG. 2) in the working area WA1 in the manner as shown in FIG. 4. At next step S45, it is determined whether or not any program change event (FIG. 3) has been read out from the event buffer EVBUF. If a negative determination results at step S45, the program jumps to step S50 of FIG. 8; otherwise, the program branches to step S46 in order to determine whether or not the MIDI channel associated with the program change event is the MIDI channel "MPUMIDI-CH(m)" ((b) of FIG. 2) managed by the MPU 1 on the basis of data "MIDI-CH" contained in the program change event. If answered in the affirmative at step S46, the program proceeds to step S47, where tone color of a tone waveform to be synthesized by the MPU 1 for the MIDI channel is reset in accordance with data "PROGRAMNo." contained in the event. Then, the program goes to step S49.

If answered in the negative at step S46 (i.e., if the MIDI channel associated with the changed tone color is one managed by one of the hardware tone generators), the program branches to step S48, where the responsible hardware tone generator resets tone color of a tone waveform to be synthesized by the hardware tone generator for the MIDI channel in accordance with the data "PROGRAMNo." Then, the program goes to step S49. At step S49, a further determination is made as to whether any other program change has been read out. If so, the program loops back to step S46 in order to repeat the operations at and after step S46 for the program change; otherwise, the program proceeds to step S50 of FIG. 8.

At step S50, it is determined whether or not a key event (FIG. 3) has been read out from the event buffer EVBUF. With a negative determination, the program jumps to step S62 for a tone generating process, while with an affirmative determination, the program goes to step S51. At step S51, a determination is made as to whether or not the MIDI channel associated with the key event is the MIDI channel "MPUMIDI-CH(m)" (block (b) of FIG. 2) managed by the MPU 1 on the basis of data "MIDI-CH" contained in the key event.

If answered in the affirmative at step S51, the program proceeds to step S52 to execute a process for identifying tone generating channels for the MPU 1. More specifically, if the key event is of a key code for which no key-on event has been generated, the program allocates to the MPU 1 "x" tone generating channels necessary for a tone color corresponding to the MIDI channel associated with the key event. If, on the other hand, the key event is of a key code for which a key-on event has already been generated, the program identifies "x" tone generating channels already allocated to the MPU 1 on the basis of the key-on event.

At next step S53, a determination is made as to whether or not the key event is a key-on event. If so, the program goes to step S54 in order to set a value "1" to the key-on flags KONFLG (block (b) of FIG. 2) of the "x" tone generating channels within the range from channel No. CH"1" to channel No. CH"MPUCHNUM". After this, the program proceeds to step S61. If, on the other hand, the key event is a key-off event as determined at step S53, the program proceeds to step S55, where it sets a value "1" to the key-off flags KONFLG (block (b) of FIG. 2) of the "x" tone generating channels within the range from channel No. CH"1" to channel No. CH"MPUCHNUM" for which the key-on flags KONFLG have already been set to "1" in relation to the "x" tone generating channels identified at step S53. Then, the program proceeds to step S61.

If answered in the negative at step S51 (i.e., if the MIDI channel associated with the key event is one managed by any of the hardware tone generators), the program goes to step S56 in order to further determine whether the hardware tone generator is currently available. If not available, the program branches to the above-mentioned step S52. Thus, when the hardware tone generator is not currently available, the MIDI channel for which the hardware tone generator is responsible can be managed by the MPU 1 in place of the hardware tone generator. If, on the other hand, an affirmative answer results at step S56, the program proceeds to step S57 in order to execute a process for identifying tone generating channels for the hardware tone generator. More specifically, if the key event is of a key code for which a key-on event has not been generated, the program allocates to the hardware tone generator "x" tone generating channels necessary for a tone color corresponding to the MIDI channel associated with the key event. If, on the other hand, the key event is of a key code for which a key-on event has already been generated, the program identifies "x" tone generating channels already allocated to the hardware tone generator on the basis of the key-on event.

At next step S58, a determination is made as to whether or not the key event is a key-on event. If so, the program goes to step S59 in order to set a value "1" to the key-on flags KONFLG (block (b) of FIG. 2) of the "x" tone generating channels within the range from channel No. CH"MPUCHNUM+1" to channel No. CH"MPUCHNUM+HARDCHNUM". After this, the program proceeds to step S61. If, on the other hand, the key event is a key-off event as determined at step S58, the program proceeds to step S60, where it sets a value "1" to the key-off flags KONFLG ((b) of FIG. 2) of the "x" tone generating channels within the range from channel No. CH"MPUCHNUM+1" to channel No. CH"MPUCHNUM+HARDCHNUM" for which the key-on flags KONFLG have already been set to "1" in relation to the "x" tone generating channels identified at step S57. Then, the program proceeds to step S61.

At step S61, a determination is made as to whether any other program change event (FIG. 3) has been read out. With an affirmative determination, the program loops back to step S51 in order to repeat the operations for the other program change event at and after step S51. With a negative (NO) determination, the program goes to step S62 for the tone generating process.

Figure 9:
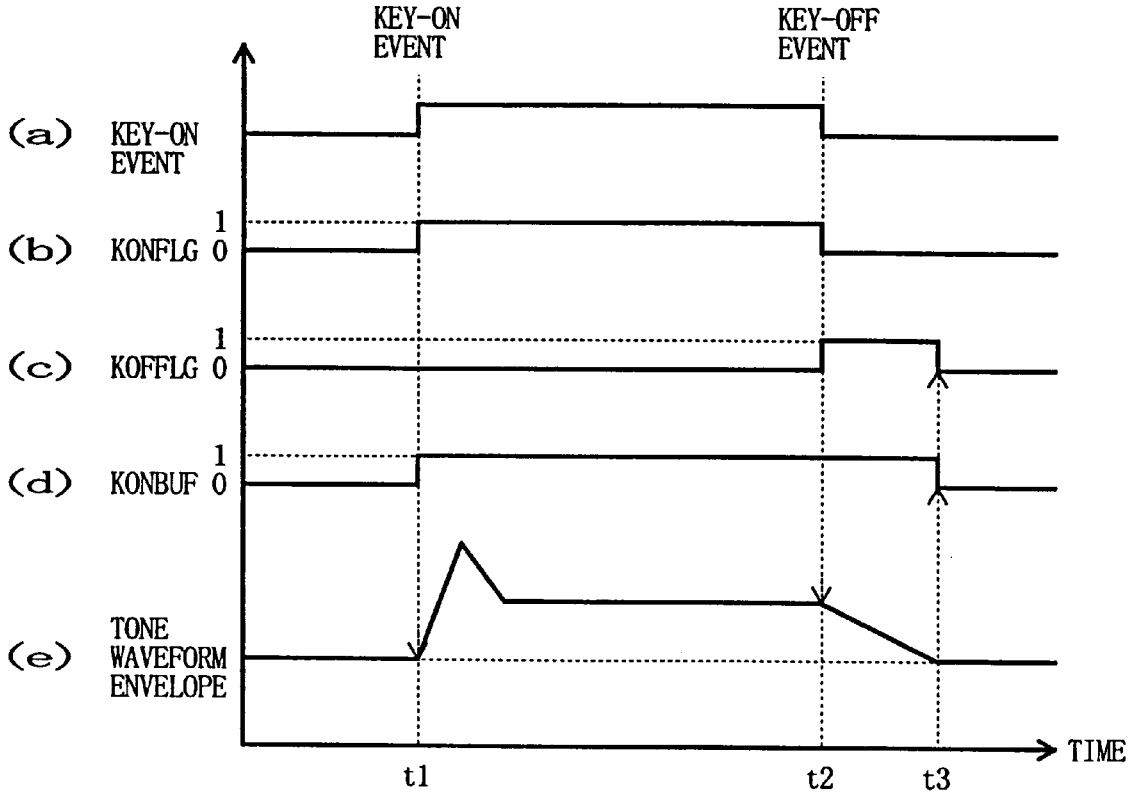
FIG. 9 is a time chart illustrating exemplary time-variant relationships among generation timing of key-on and key-off events, various flags and tone waveform generation.

Exemplary time-variant relationships among generation timing of key-on and key-off events and set values in the key-on and key-off flags KONFLG and KOFFLG are as shown in (a) to (c) of FIG. 9. When a key-on event is generated at time t1, the value of the key-on flag KONFLG is changed from "0" to "1" by the above-mentioned operation of step S54 or S59. Then, when a key-off event is generated at time t2, the value of the key-off flag KOFFLG is changed from "0" to "1" by the above-mentioned operation of step S55 or S60.

Figure 10:
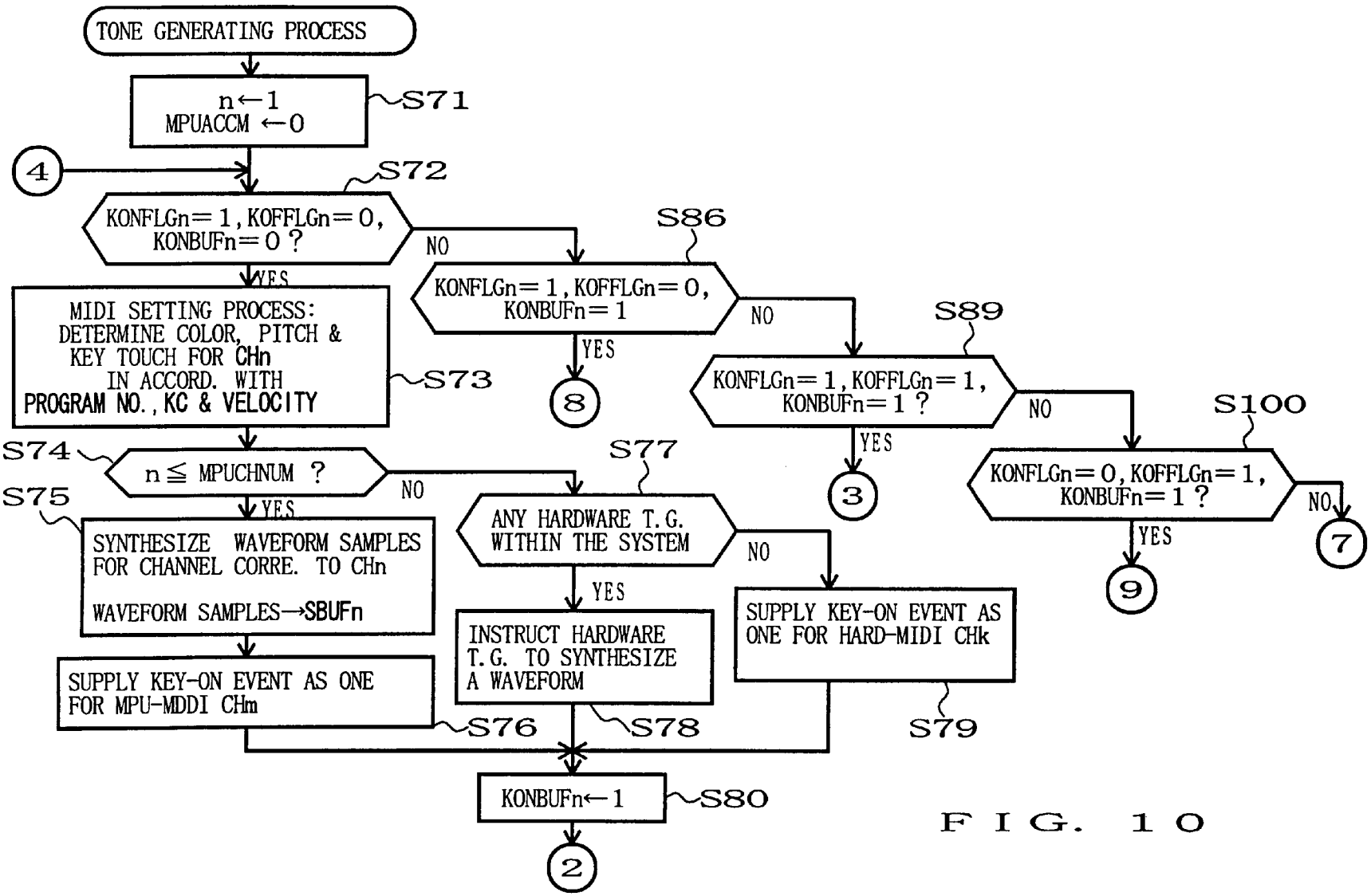
FIG. 10 is a flowchart showing an example of a portion of tone generating processing of FIG. 8.

A detailed example of the tone generating process at step S62 of FIG. 8 will next be described with reference to FIGS. 10 to 16. First, as shown in FIG. 10, step S71 sets variable "n", which is indicative of a tone generating channel number, to "1" and clears the accumulated tone waveform data MPUACCM (block (b) of FIG. 2) in the working area WA2 of the RAM 3. After this, a determination is made at step S72 as to whether the key-on flag KONFLGn, key-off flag KOFFLGn and key-on buffer KONBUFn for channel number CHn are currently at values "1", "0" and "0", respectively.

Operations When an Affirmative Determination is Made at Step S72

If the key-on flag KONFLGn for channel number CHn has been set to "1" at step S54 or S59 on the basis of generation of a key-on event, an affirmative (YES) determination results at step S72 so that the program proceeds to step S73. At step S73, tone color, pitch and key touch for channel number CHn are determined on the basis of data "KC" and "VELOCITY" (FIG. 3) for channel number CHn as well as the tone color that was related, via the MIDI setting process of step S39 of FIG. 7, to the MIDI channel associated with the key-on event (the tone color reset at step S48 or S49 of FIG. 7 in accordance with data "PROGRAMNo." of the event in a case where a program change event has occurred for a MIDI channel).

At next step S74, it is determined whether or not variable "n" is smaller than the number "MPUCHNUM", i.e., whether or not channel number CHn is one that should correspond to any of the tone generating channels allocated to the MPU 1. At the very beginning, "n" is "1", so that an affirmative (YES) determination results at step S74 and the program goes to step S75. At step S75, arithmetic operations are executed to synthesize a predetermined number of samples of a tone waveform having the tone color, pitch and key touch determined at step S73 for the tone generating channel of the MPU 1 corresponding to channel number CHn, in the synthesizing method set at step S36 of FIG. 7 and at the sampling frequency set at step S37 of FIG. 7. In response to this, synthesis of the tone waveform for the tone generating channel is started from its attack portion as shown approximately at time t1 in item (e) of FIG. 9. Then, resultant synthesized tone waveform data are written into the sound buffer SBUFn (block (b) of FIG. 2) in the working area WA2 corresponding to channel number CHn.

At step S76 following step S75, the key-on event is supplied via the MIDI output terminals of the external interface 5 or extension external interface 14 to any of the MIDI-connected external tone generator devices as a key-on event for MIDI channel "MPUMIDI-CH(m)" managed by the MPU 1, in such a manner that the external tone generator device can also synthesize a tone waveform in response to the key-on event.

At next step S80, the key-on buffer KONBUFn for channel number CHn is set to "1" as shown approximately at time t1 in item (d) of FIG. 9. Then, the program proceeds to step S81 of FIG. 11 in order to determine whether variable "n" is equivalent to or smaller than the number "MPUCHNUM". At the very beginning, "n" is "1", so that an affirmative (YES) determination results at step S81 and the program goes to step S82. At step S82, the tone waveform data in the sound buffer SBUFn are added to the current accumulated tone waveform data MPUACCM (block (b) of FIG. 2) in the working area WA2, and the addition result is written as new accumulated tone waveform data MPUACCM into the working area WA2. In this way, tone waveform data synthesized by the MPU 1 for the individual tone generating channels will be accumulated in a sequential manner. After step S82, the program goes to step S83 in order to increment variable "n" by one. At next step S84, a determination is made as to whether variable "n" has exceeded the number "MPUCHNUM+HARDCHNUM". At the very beginning, "n" is "1", so that an affirmative (YES) determination results at step S84 and the program reverts to step S72 of FIG. 10.

Operations When an Affirmative Determination is Made at Step S86

Referring back to FIG. 10, if a negative (NO) determination results at step S72, the program branches to step S86 to further determine whether the key-on flag KONFLGn, key-off flag KOFFLGn and key-on buffer KONBUFn for channel number CHn are currently at values "1", "0" and "1", respectively. If the arithmetic operations have already been executed at step S75 for channel number CHn, the key-on buffer KONBUFn for channel number CHn has been set to "1", so that an affirmative determination results at step S86 and the program proceeds to step S87 of FIG. 12.

At step S87, a determination is made as to whether variable "n" is equivalent to or smaller than the number "MPUCHNUM". At the very beginning, "n" is "1", so that an affirmative (YES) determination results at step S87 and the program goes to step S88. At step S88, arithmetic operations are executed, for the MPU tone generating channel corresponding to channel number CHn, to synthesize a predetermined number of tone waveform samples following those synthesized at the above-mentioned step S75. In this way, tone waveform samples of a sustain portion following the attack portion will be synthesized for the tone generating channel as shown between time t1 and time t2 in item (e) of FIG. 9. Then, resultant synthesized tone waveform data are written into the sound buffer SBUFn in the working area WA2 corresponding to channel number CHn. After step S88, the program jumps to step S81 of FIG. 11 in order to execute operations of steps S81 to S85.

Operations When an Affirmative Determination is Made at Step S89

Referring back to FIG. 10, if a negative (NO) determination results at step S86, the program branches to step S89 to further determine whether the key-on flag KONFLGn, key-off flag KOFFLGn and key-on buffer KONBUFn for channel number CHn are currently at values "1", "1" and "1", respectively. If the key-off flag KOFFLGn for channel number CHn has been set to "1" at step S55 or S60 of FIG. 8 in response to generation of a key-off event, an affirmative (YES) determination results at step S89 and the program goes to step S90 of FIG. 13.

At step S90, a determination is made as to whether variable "n" is equivalent to or smaller than the number "MPUCHNUM". At the very beginning, "n" is "1", so that an affirmative (YES) determination results at step S90 and the program goes to step S91. At step S91, arithmetic operations are executed, for the MPU tone generating channel corresponding to channel number CHn, to synthesize a predetermined number of tone waveform samples of a release portion following the sustain portion synthesized at the above-mentioned step S88. In this way, tone waveform samples of a release portion following the sustain portion will be synthesized for the tone generating channel as shown by way of example between time t2 and time t3 in item (e) of FIG. 9. Then, resultant synthesized tone waveform data are written into the sound buffer SBUFn in the working area WA2 corresponding to channel number CHn.

At step S92 following step S91, the key-off event is supplied to the external tone generator device supplied with the key-on event earlier at step S76 of FIG. 10, as a key-off event for MIDI channel "MPUMIDI-CH(m)" managed by the MPU 1.

At next step S96, the key-on buffer KONBUFn for channel number CHn is set to "0" as shown approximately at time t2 in item (d) of FIG. 9. Then, the program proceeds to step S97 of FIG. 14, in order to check the tone volume level of the tone waveform synthesized for the tone generating channel corresponding to channel number CHn. At next step S98, a determination is made as to whether the tone volume level is currently less than a predetermined value. If answered in the negative, the program jumps to step S81 of FIG. 11 to execute the operations of steps S81 to S85. If, on the other hand, an affirmative determination results at step S97, the program proceeds to step S99, where the key-off flag KOFFLGn and key-on buffer KONBUFn for channel number CHn are both set to "0" as shown approximately at time t3 in item (d) of FIG. 9. After step S99, the program jumps to step S81 to execute the operations of steps S81 to S85.

Operations When an Affirmative Determination is Made at Step S100

Referring back to FIG. 10, if a negative (NO) determination results at step S89, the program branches to step S100 to further determine whether the key-on flag KONFLGn, key-off flag KOFFLGn and key-on buffer KONBUFn for channel number CHn are currently at values "0", "1" and "1", respectively. If the arithmetic operations have already been executed at step S91 of FIG. 13 to synthesize tone waveform samples of the release portion, the key-on buffer KONBUFn for channel number CHn has been set to "0" at step S96 of FIG. 13; thus, an affirmative determination results at step S100 and the program proceeds to step S101 of FIG. 15, provided that the tone volume level of the tone waveform is still below the predetermined value and hence the program has not yet executed step S99 of FIG. 14.

At step S101, a determination is made as to whether variable "n" is equivalent to or smaller than the number "MPUCHNUM". At the very beginning, "n" is "1", so that an affirmative (YES) determination results at step S101 and the program goes to step S102. At step S102, arithmetic operations are executed, for the MPU tone generating channel corresponding to channel number CHn, to synthesize a predetermined number of tone waveform samples of a release portion following those synthesized at the above-mentioned step S91 of FIG. 13. Then, resultant synthesized tone waveform data are written into the sound buffer SBUFn in the working area WA2 corresponding to channel number CHn. After step S102, the program jumps to step S97 of FIG. 14 in order to repeat the operations from step S97 to step S85 of FIG. 11.

Operations When a Negative Determination is Made at Step S100

Referring back to FIG. 10, if, for channel number CHn, the key-on buffer KONBUFn has been set to "0" at step S96 due to the execution of the arithmetic operations at step S91 for synthesizing tone waveform samples of the release portion and the key-off flag KOFFLGn and key-on buffer KONBUFn have been set to "0" at step S99 due to attenuation of the tone waveform volume level to below the predetermined value, a negative determination results at step S100 so that the program goes to step S103. Similarly, if the key-on flag KONFLGn for channel number CHn is not set to "1" from the beginning, i.e., if no tone generation has been assigned to the tone generating channel corresponding to channel number CHn, a negative determination results at step S100 so that the program goes to step S103.

At step S103, a determination is made as to whether variable "n" is now equivalent to or smaller than the number "MPUCHNUM". At the very beginning, "n" is "1", so that an affirmative (YES) determination results at step S104 and the program goes to step S104. At step S104, arithmetic operations are executed, for the MPU tone generating channel corresponding to channel number CHn, to synthesize a predetermined number of imaginary tone waveform samples, all of zero level, following those synthesized at the above-mentioned step S91 of FIG. 13. Consequently, the tone waveform volume level for the tone generating channel will turn into zero as shown after time t3 in item (d) of FIG. 9. Such zero-level imaginary data are written into the sound buffer SBUFn in the working area WA2. After step S104, the program jumps to step S81 of FIG. 11 in order to repeat the above-described operations from step S81 to step S85.

Figure 8:
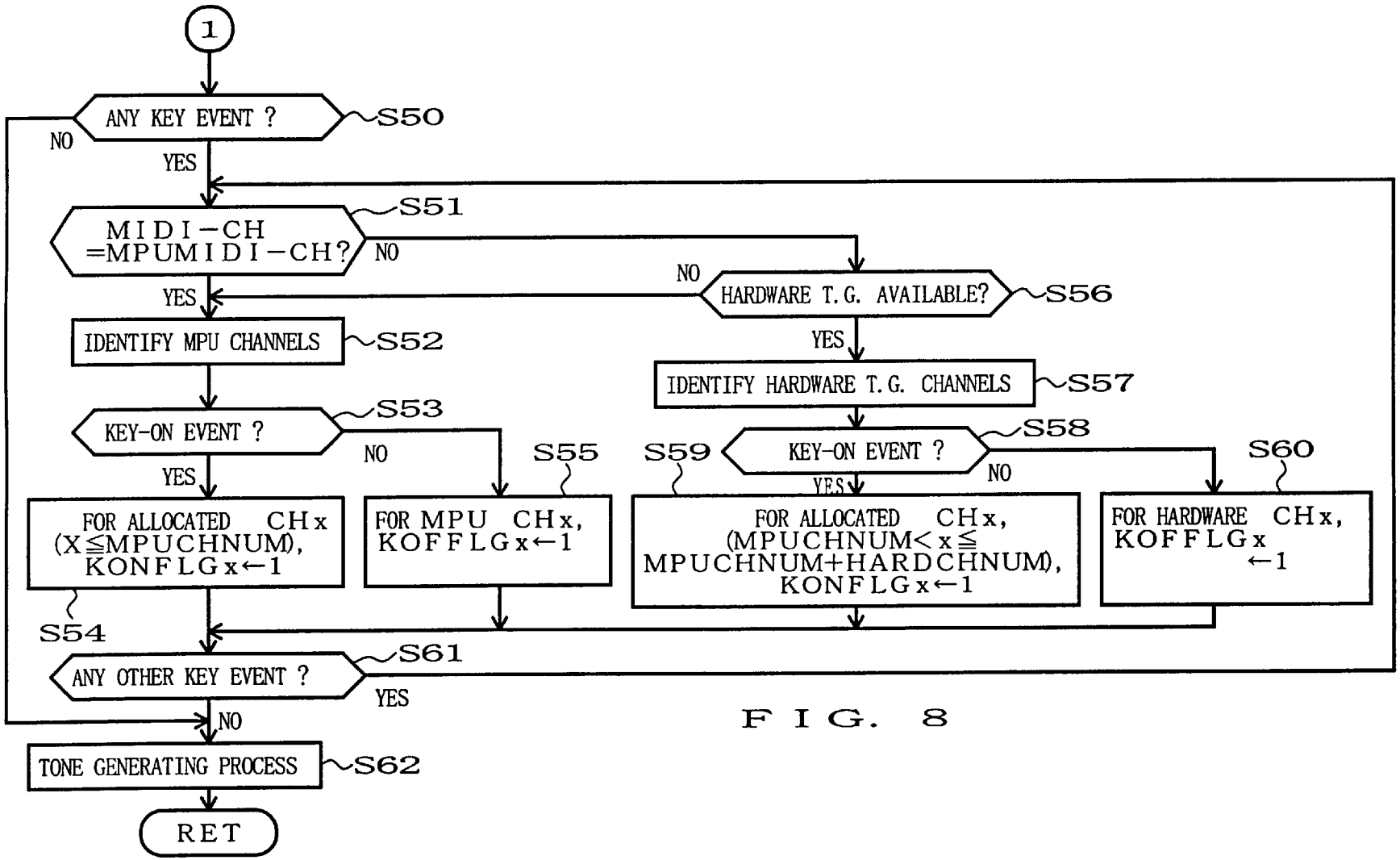
FIG. 8 is a flowchart showing an example of a remaining portion of the processing of tone-waveform generating application software shown in FIG. 5.

By repeating the above-described operations until the condition of "n"="MPUCHNUM" is met, a tone waveform is sequentially synthesized for the "x" tone generating channels allocated to the MPU 1 at step S54 of FIG. 8. Once variable "n" has exceeded the number "MPUCHNUM" (i.e., once channel number CHn has reached a channel number that should correspond to one of the channels allocated to any one of the hardware tone generators), the following operations take place.

Operations When an Affirmative Determination is Made at Step S72

A negative determination results at step S74 of FIG. 10, so that the program branches to step S77, where a determination is made as to whether or not any hardware tone generator is provided within the present music system. If answered in the affirmative, the internal hardware tone generator, allocated at step S57 of FIG. 7 a tone generating channel corresponding to channel number CHn, is instructed to synthesize a tone waveform with the tone color, pitch and key touch determined at step S73 for the channel (step S78). In response to the instruction, the hardware tone generator within the system executes tone synthesizing processing for the channel on the basis of the key-on event. After step S78, the program goes to step S80. If, on the other hand, a negative determination results at step S77, the key-on event is supplied via the MIDI output terminals of the external interface 5 or extension external interface 14 to any of the external tone generator devices as a key-on event for MIDI channel "HARDMIDI-CH(k)" managed by the hardware tone generator, in such a manner that the external tone generator device can synthesize a tone waveform in response to the key-on event (step S79). After step S79, the program goes to step S80. Also, the program jumps from step S81 of FIG. 11 to step S83.

Operations When an Affirmative Determination is Made at Step S86

Figure 11:
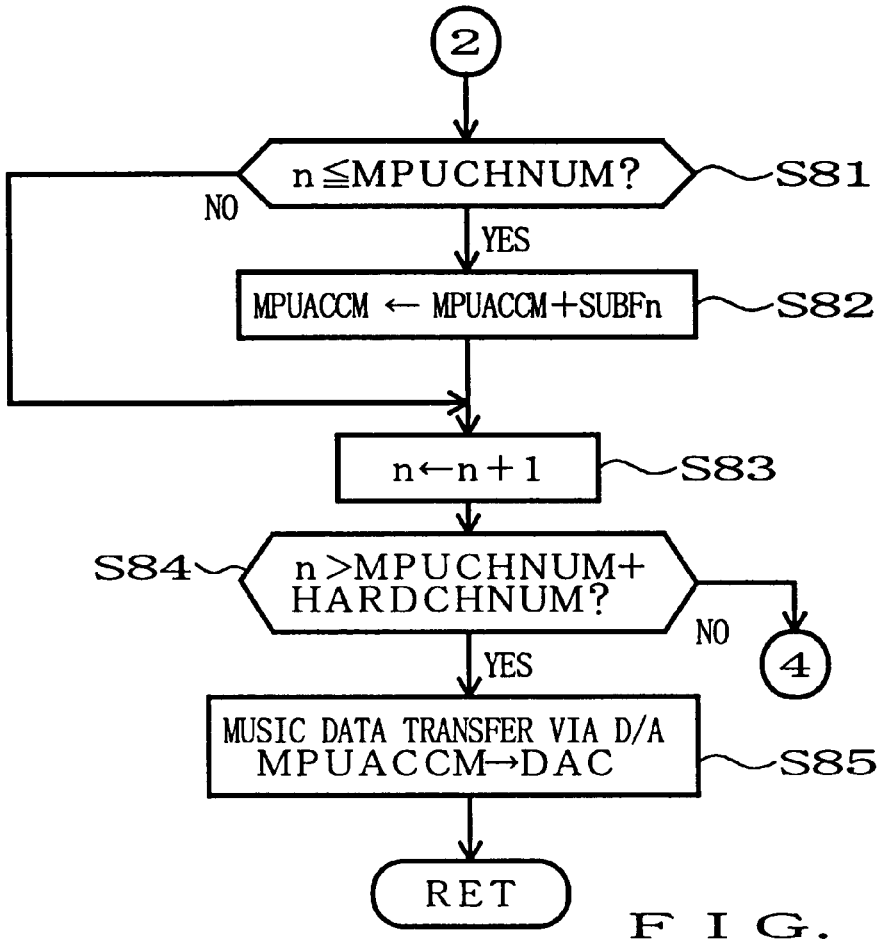
FIG. 11 is a flowchart showing an example of another portion of the tone generating processing of FIG. 8.
Figure 12:
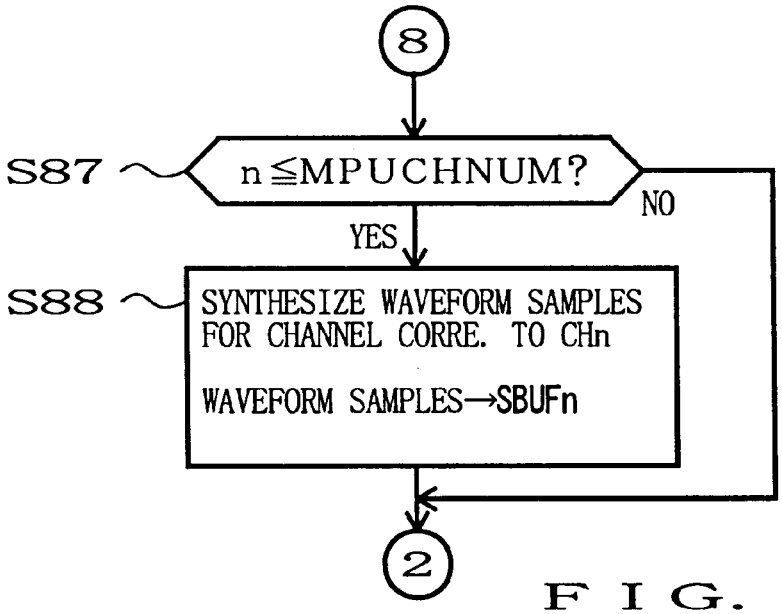
FIG. 12 is a flowchart showing an example of still another portion of the tone generating processing of FIG. 8.

A negative determination results at step S87 of FIG. 12, so that the program jumps to step S81 of FIG. 11.

Operations When an Affirmative Determination is Made at Step S89

Figure 13:
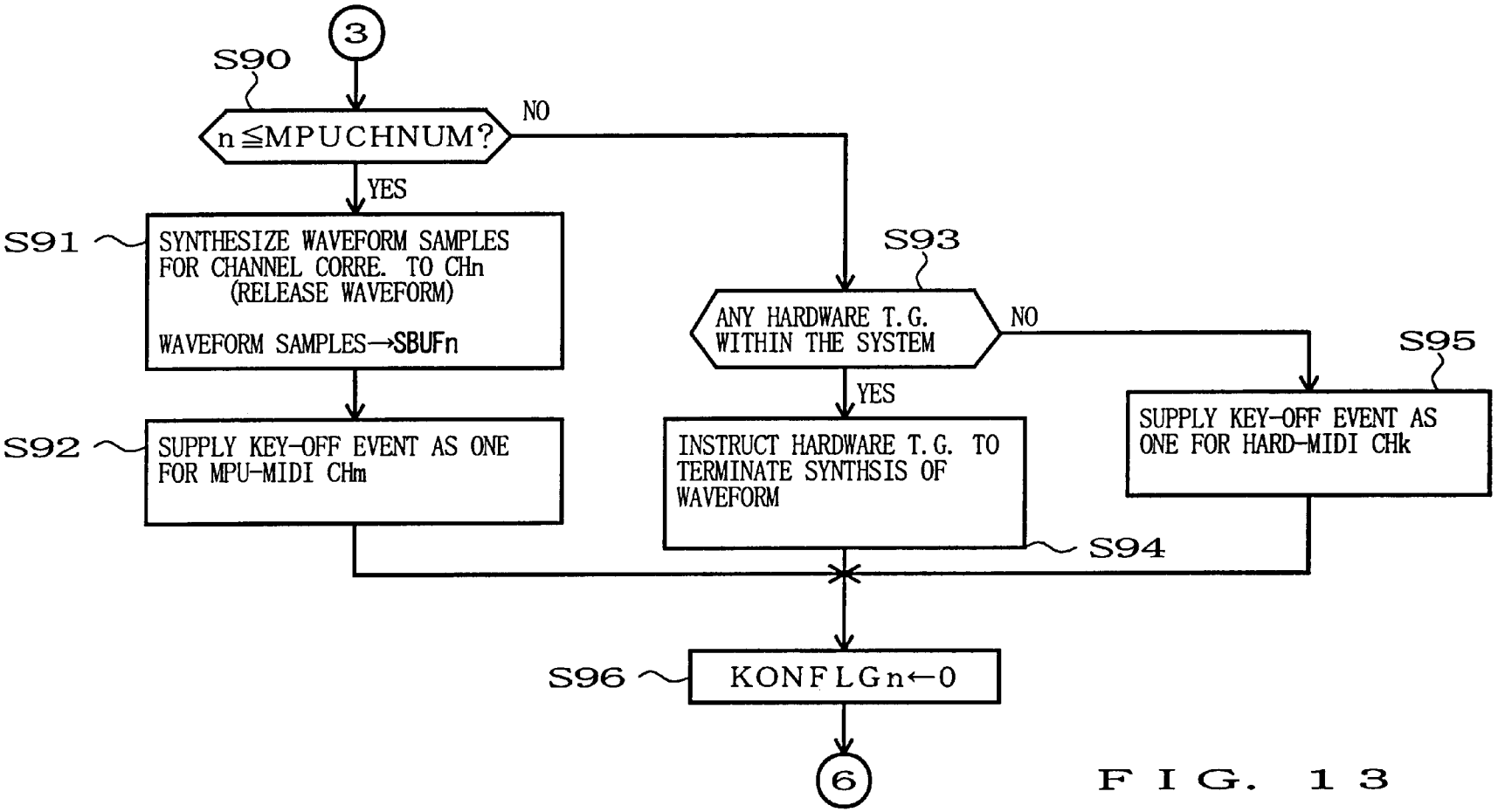
FIG. 13 is a flowchart showing an example of still another portion of the tone generating processing of FIG. 8.

A negative determination results at step S90 of FIG. 13, so that the program branches to step S93, where a determination is made as to whether or not any hardware tone generator is provided within the present music system. If answered in the affirmative, the internal hardware tone generator, allocated at step S57 of FIG. 7 a tone generating channel corresponding to channel number CHn, is instructed to terminate the tone synthesizing processing for that channel CHn (step S94). In response to the instruction, the hardware tone generator within the music system terminates the tone synthesizing processing. After step S94, the program goes to step S96.

If, on the other hand, a negative determination results at step S93, the key-off event is supplied via the MIDI output terminals of the external interface 5 or extension external interface 14 to the external tone generator device supplied with the key-on event earlier at step S79 of FIG. 10, as a key-off event for MIDI channel "HARDMIDI-CH(k)" managed by the internal hardware tone generator (step S95). In response to this, the external tone generator device terminates the tone synthesizing processing for the tone generating channel. After step S95, the program goes to step S96.

Operations When an Affirmative Determination is Made at Step S100

Figure 14:
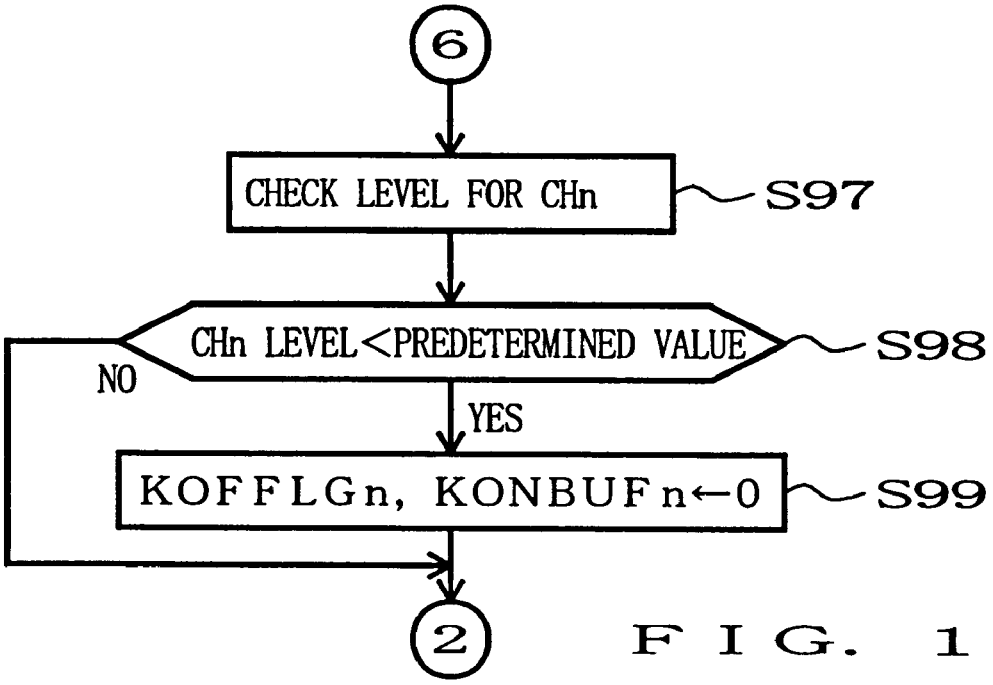
FIG. 14 is a flowchart showing an example of still another portion of the tone generating processing of FIG. 8.
Figure 15:
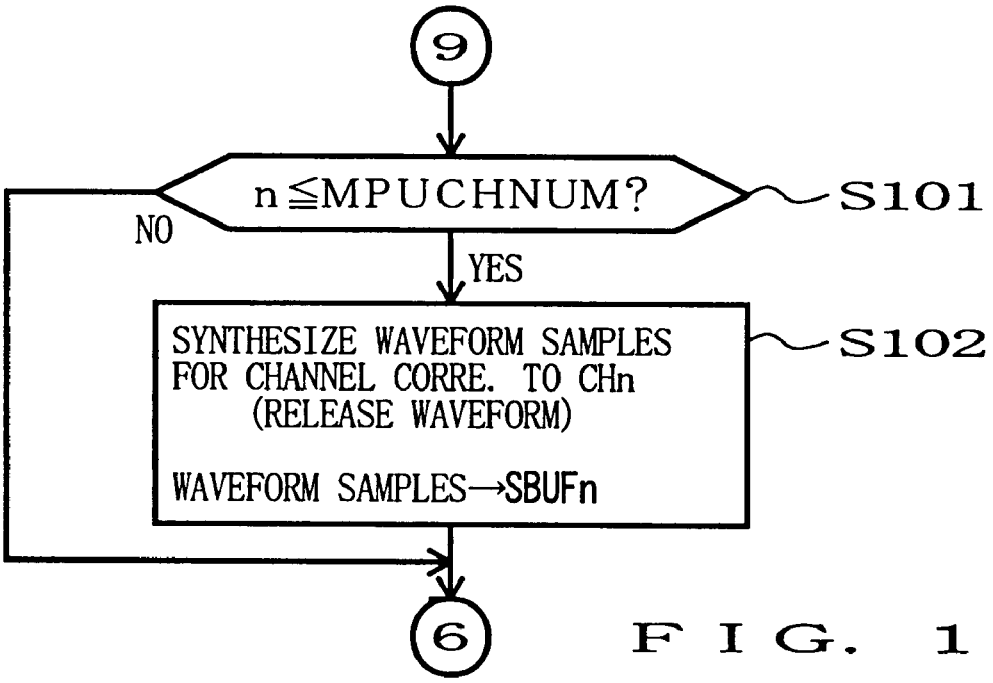
FIG. 15 is a flowchart showing an example of still another portion of the tone generating processing of FIG. 8.

A negative determination results at step S101 of FIG. 15, so that the program jumps to step S97 of FIG. 14.

Operations When a Negative Determination is Made at Step S100

Figure 16:
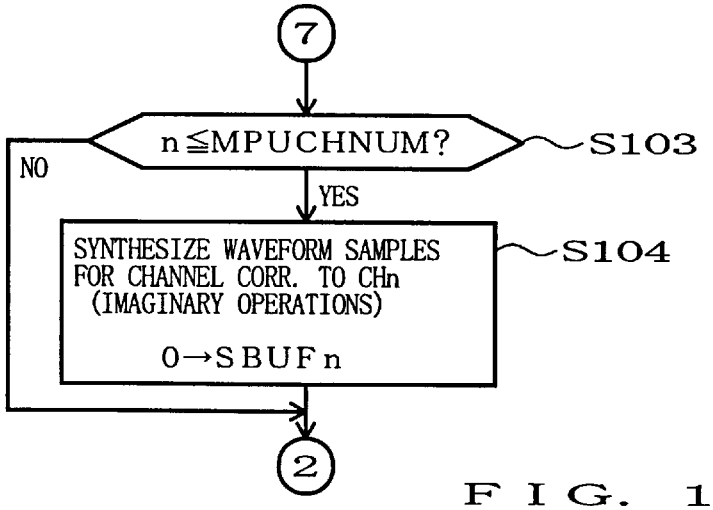
FIG. 16 is a flowchart showing an example of still another portion of the tone generating processing of FIG. 8.

A negative determination results at step S103 of FIG. 16, so that the program jumps to step S81 of FIG. 11.

By repeating the above-described operations until the condition of "n" ="MPUCHNUM+HARDCHNUM" is met, a tone waveform is sequentially synthesized for the "x" tone generating channels allocated to the hardware tone generator at step S59 of FIG. 8. Once variable "n" has exceeded the number "MPUCHNUM+HARDCHNUM", an affirmative determination results at step S84 so that the program proceeds to step S85. At step S85, the accumulated data MPUACCM in the working area WA2 (i.e., accumulation of the tone waveform data of the "x" tone generating channels synthesized by the MPU 1) are transferred to the sound system (not shown) via the D/A converter 17 on the analog conversion board 12. In this way, tones of the MIDI channels managed by the MPU 1 will be audibly reproduced via the sound system. It should be understood that the accumulation of the tone waveform data of the "x" tone generating channels synthesized by the hardware tone generator are also transferred from the hardware tone generator to a sound system for audible reproduction once variable "n" has exceeded the number "MPUCHNUM+HARDCHNUM". After step S85, the program returns.

As set forth above, the computer music system of the invention is designed in such a manner that the tone synthesizing processing for the individual tone generating channels allocated to the internal hardware tone generator is executed by the internal hardware tone generator or external tone generator device on the basis of the operation of step S78, S79, S94 or S95 after the arithmetic operations have been completed at one of step S75, S88, S91 and S101 for the number "MPUCHNUM" of tone generating channels allocatable to the MPU 1 (and hence after the tone waveform synthesis has been completed for all of the tone generating channels allocated to the MPU 1). Therefore, by the time the tone synthesizing processing is initiated for the tone generating channels allocated to the internal hardware tone generator, the time required for the MPU 1 to effect these arithmetic operations has already passed away. As a result, tone generation timing for the MIDI channels managed by the MPU 1 and tone generation timing of the MIDI channels managed by the internal hardware tone generator will be brought into agreement with each other irrespective of the time delay caused in the arithmetic operations by the MPU 1.

Figure 17:
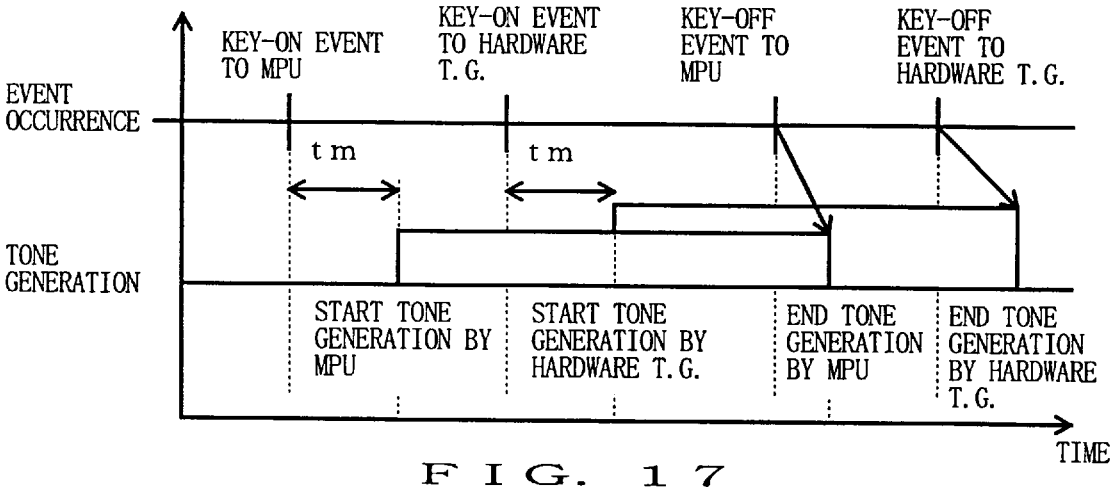
FIG. 17 is a chart showing exemplary time differences between tone generation timing for MIDI channels managed by the MPU and tone generation timing of MIDI channels managed by a hardware tone generator.

FIG. 17 is a chart showing exemplary time differences between the tone generation timing for the MIDI channels managed by the MPU 1 and the tone generation timing of the MIDI channels managed by the internal hardware tone generator. In the illustrated example, tone generation is started, for any of the MIDI channels managed by the MPU 1, with a delay time "tm" after occurrence of a key-on event. Because operations based on a key-on event generated for the MIDI channel managed by the internal hardware tone source are also initiated after lapse of the time "tm", the start of the tone generation for the MIDI channel will also be delayed by the time "tm" if a time required for a dedicated tone generator device to effect the tone synthesizing processing is considered to be zero. In this way, the tone-generation start timing for the MIDI channel managed by the MPU 1 and tone-generation start timing of the MIDI channels managed by the internal hardware tone generator will match or agree with each other. Then, the tone generation is terminated, for the MIDI channel managed by the MPU 1, with a delay time after occurrence of a key-off event, and operations based on a key-off event generated for the MIDI channel managed by the internal hardware tone source are also initiated after lapse of the delay time and hence delayed by that time. In this way, the tone-generation end timing for the MIDI channel managed by the MPU 1 and tone-generation end timing of the MIDI channels managed by the internal hardware tone generator will also agree with each other.

With such an arrangement, the present music system is allowed to execute an ensemble performance of a same music piece while keeping in unison generation timing of tones synthesized by the MPU 1 and tones synthesized by the dedicated tone generator device.

The embodiment of the present invention has been described above as immediately going to step S77 or S93 when the variable "n" exceeds the number "MPUCHNUM" and a negative determination results at step S74 of FIG. 10 or at step S90 of FIG. 13. Alternatively, if a negative determination results at step S74 or at step S90, it may be ascertained whether or not there has elapsed a given allowance time preset to be considerably greater than an expected delay time when the MPU 1 executes the operations for the number "MPUCHNUM" of tone generating channels so that the program goes to step S77 or S93 only after lapse of the given allowance time. Thus, irrespective of uneven delay times resulting as the MPU 1 executes the operations for number "MPUCHNUM" of tone generating channels a plurality of times, a music piece can be performed with tone generation timing properly matched at each of the times.

While the embodiment of the present invention has been described above as using, as a dedicated tone generator device, the tone generator provided within the personal computer and extension board attached to the extension slot, the present invention may of course be applied to a computer music system which employs either one of the tone generator within the personal computer and extension board. Further, the present invention may be employed to allow both the CPU provided within a dedicated electronic musical instrument and the tone generator to execute the tone synthesizing processing.

In the above-described embodiment, a determination as to whether tone synthesizing processing corresponding to performance information should be executed by the general-purpose CPU or by the dedicated tone generator is made through execution of a predetermined program by the CPU. In other words, a determining device for that purpose comprises a software program. Alternatively, the determining device may comprise dedicated hardware.

Further, while the dedicated tone generator is implemented by a hardware tone generator device in the above-described embodiment, it may be implemented by a software tone generator device according to the basis principle of the present invention. Namely, the dedicated tone generator may be arranged with a second CPU and tone generator software program run by the second CPU. In such a case as well, the inconveniences resulting from time delays are significantly lessened as compared to the tone synthesizing processing executed by the first CPU that is shared for not only the tone synthesizing processing but also for other processing. Thus, the present inventive idea of instructing the second CPU to execute the tone synthesizing processing after completion of the tone synthesizing processing by the first CPU will be very useful for proper synchronization between the two.

The present invention arranged in the above-described manner is characterized by executing control such that a dedicated tone generating device conducts tone synthesizing processing after a general-purpose processor has completed tone synthesizing processing. Thus, by the time the dedicated tone generating device initiates the tone synthesizing processing, the time required for the general-purpose processor to execute the tone synthesizing processing has already passed away. Consequently, irrespective of time delay in the tone synthesizing processing by the processor, generation timing of tones synthesized by the general-purpose processor and tones synthesized by the dedicated tone generating device can always agree with each other. With such an arrangement, the present invention permits both the general-purpose processor and the dedicated tone generating device to execute an ensemble performance of a same music piece or the like, with the result that the present invention can further increase the number of simultaneously generatable tones in a music piece performance and achieve increased tone color variations.

What is claimed is:

1. A tone synthesizing apparatus comprising:

a device adapted to receive performance information having a plurality of musical events;

a general-purpose processor adapted to execute tone synthesizing processing;

a dedicated tone generating device adapted to execute tone synthesizing processing; and a control device which, for each of the events of the performance information received by said adapted device, instructs at least one of said general-purpose processor and said dedicated tone generating device to execute the tone synthesizing processing based on the event, wherein when said control device is to instruct said dedicated tone generating device to execute the tone synthesizing processing based on the event, said control device instructs said dedicated tone generating device to execute the tone synthesizing processing only after a lapse of a time that is necessary for said general-purpose processor to perform the tone synthesizing processing, to thereby adjust tone generation timing of said dedicated tone generating device to tone generation timing of said general-purpose processor.

2. A tone synthesizing apparatus as recited in claim 1 wherein said control device delays timing of instructing said dedicated tone generating device to execute the tone synthesizing processing, by delaying issuance of a command instructing said dedicated tone generating device to initiate tone generation.

3. A tone synthesizing apparatus as recited in claim 1 wherein said general-purpose processor collectively executes the tone synthesizing processing for a plurality of samples of each individual tone for a plurality of channels.

4. A tone synthesizing apparatus comprising:

a device adapted to receive performance information having a plurality of musical events, each of the events containing a MIDI channel number;

a general-purpose processor adapted to execute tone synthesizing processing;

a dedicated tone generating device which executes tone synthesizing processing; and a control device that includes a memory device for storing information containing assignment of MIDI channels to at least one of said general-purpose processor and said dedicated tone generating device, wherein for each of the events of the performance information received by said adapted device, said control device indicates, in accordance with the information stored in said memory device and the channel number contained in the event, which one of said general-purpose processor and said dedicated tone generating device should execute the tone synthesizing processing based on the event.

5. A tone synthesizing apparatus comprising:

a device adapted to receive performance information having a plurality of musical events;

a general-purpose processor adapted to execute tone synthesizing processing;

a dedicated tone generating device which executes tone synthesizing processing;

a first control device which, for each of the events of the performance information received by said adapted device, indicates which one of said general-purpose processor and said dedicated tone generating device should execute the tone synthesizing processing based on the event; and a second control device which ascertains whether said dedicated tone generating device is available or not, and which, when it is ascertained that said dedicated tone generating device is not available, indicates that the tone synthesizing processing based on the event of the performance information received by said adapted device should be executed by said general-purpose processor irrespective of indication by said first control device.

6. A tone synthesizing apparatus as recited in claim 5 wherein each of the events of the performance information contains a MIDI channel number, and wherein in accordance with the channel number contained in the event of the performance information received by said adapted device, said first control device indicates which one of said general-purpose processor and said dedicated tone generating device should execute the tone synthesizing processing based on the event.

7. A tone synthesizing apparatus comprising:

a device adapted to receive performance information having a plurality of musical events;

a general-purpose processor adapted to execute tone synthesizing processing;

a first control device which, for each of the events of the performance information received by said adapted device, indicates which one of said general-purpose processor and a dedicated tone generating device should execute the tone synthesizing processing based on the event; and a second control device which, when said first control device indicates that the tone synthesizing processing based on the event of the performance information received by said adapted device should be executed by said dedicated tone generating device, ascertains whether or not said tone synthesizing apparatus additionally includes said dedicated tone generating device, and which instructs said dedicated tone generating device to execute the tone synthesizing processing based on the event when it is ascertained that said tone synthesizing apparatus additionally includes said dedicated tone generating device, but outputs the performance information including the event to outside said tone synthesizing apparatus via a predetermined output terminal when it is ascertained that said tone synthesizing apparatus does not additionally include said dedicated tone generating device.

8. A tone synthesizing apparatus as recited in claim 7 wherein in outputting the performance information including the event via the predetermined output terminal, said second control device delays output timing of the performance information, to thereby adjust tone generation timing of said dedicated tone generating device to coincide with tone generation timing of said general-purpose processor.

9. A method of synthesizing a tone by use of a general-purpose processor adapted to execute tone synthesizing processing and a dedicated tone generating device for also executing tone synthesizing processing, said method comprising:

a first step of receiving performance information having a plurality of musical events;

a second step of, for each of the events of the performance information received during said first step, instructing at least one of said general-purpose processor and said dedicated tone generating device to execute the tone synthesizing processing based on the event, wherein said second step further comprises instructing said dedicated tone generating device to execute the tone synthesizing processing based on the event, and instructing said dedicated tone generating device to execute the tone synthesizing processing only after a lapse of a time that is necessary for said general-purpose processor to perform the tone synthesizing processing, to thereby adjust tone generation timing of said dedicated tone generating device to tone generation timing of said general-purpose processor.

10. A method of synthesizing a tone by use of a general-purpose processor adapted to execute tone synthesizing processing and a dedicated tone generating device for also executing tone synthesizing processing, said method comprising:

a first step of receiving performance information having a plurality of musical events, each of the events containing a channel number; and a second step of, for each of the events of the performance information received during said first step, indicating in accordance with the channel number contained in the event which one of said general-purpose processor and said dedicated tone generating device should execute the tone synthesizing processing based on the event.

11. A method of synthesizing a tone by use of a general-purpose processor adapted to execute tone synthesizing processing and a dedicated tone generating device for also executing tone synthesizing processing, said method comprising:

a first step of receiving performance information having a plurality of musical events;

a second step of, for each of the events of the performance information received during said first step, indicating which one of said general-purpose processor and said dedicated tone generating device should execute the tone synthesizing processing based on the event; and a third step of ascertaining whether said dedicated tone generating device is available or not, and, when it is ascertained said dedicated tone generating device is not available, indicating that the tone synthesizing processing based on the event of the performance information received by said first step should be executed by said general-purpose processor irrespective of indication by said second step.

12. A method of synthesizing a tone by use of a general-purpose processor adapted to execute tone synthesizing processing and a dedicated tone generating device optionally provided for also executing tone synthesizing processing, said method comprising:

a first step of receiving performance information having a plurality of musical events;

a second step of, for each of the events of the performance information received during said first step, indicating which one of said general-purpose processor and said dedicated tone generating device should execute the tone synthesizing processing based on the event; and a third step of, when said second step indicates that the tone synthesizing processing based on the event of the performance information received by said first step should be executed by said dedicated tone generating device, ascertaining whether or not said dedicated tone generating device is optionally provided, and outputting the performance information including the event via a predetermined output terminal when it is ascertained that said dedicated tone generating device is not provided.

13. A machine-readable recording medium containing a group of instructions of a program for synthesizing a tone by use of a general-purpose processor adapted to execute tone synthesizing processing and a dedicated tone generating device for also executing tone synthesizing processing, said medium causing a machine to perform the steps of:

a first step of receiving performance information having a plurality of musical events;

a second step of, for each of the events of the performance information received during said first step, indicating which one of said general-purpose processor and said dedicated tone generating device should execute the tone synthesizing processing based on the event, wherein when said second step instructs said dedicated tone generating device to execute the tone synthesizing processing based on the event, said second step further comprises instructing said dedicated tone generating device to execute the tone synthesizing processing only after a lapse of a time that is necessary for said general-purpose processor to perform the tone synthesizing processing, to thereby adjust tone generation timing of said dedicated tone generating device to tone generation timing of said general-purpose processor.

14. A machine-readable recording medium containing a group of instructions of a program for synthesizing a tone by use of a general-purpose processor adapted to execute tone synthesizing processing and a dedicated tone generating device for also executing tone synthesizing processing, said medium causing a machine to perform the steps of:

a first step of receiving performance information having a plurality of musical events, each of the events containing a channel number; and a second step of, for each of the events of the performance information received during said first step, indicating in accordance with the channel number contained in the event which one of said general-purpose processor and said dedicated tone generating device should execute the tone synthesizing processing based on the event.

15. A machine-readable recording medium containing a group of instructions of a program for synthesizing a tone by use of a general-purpose processor adapted to execute tone synthesizing processing and a dedicated tone generating device for also executing tone synthesizing processing, said medium causing a machine to perform the steps of:

a first step of receiving performance information having a plurality of musical events;

a second step of, for each of the events of the performance information received during said first step, indicating which one of said general-purpose processor and said dedicated tone generating device should execute the tone synthesizing processing based on the event; and a third step of ascertaining whether said dedicated tone generating device is available or not, and, when it is ascertained that said dedicated tone generating device is not available, indicating that the tone synthesizing processing based on the event of the performance information received during said first step should be executed by said general-purpose processor irrespective of indication by said second step.

16. A machine-readable recording medium containing a group of instructions of a program for synthesizing a tone by use of a general-purpose processor adapted to execute tone synthesizing processing and a dedicated tone generating device optionally provided for also executing tone synthesizing processing, said medium causing a machine to perform the steps of:

a first step of receiving performance information having a plurality of musical events;

a second step of, for each of the events of the performance information received during said first step, indicating which one of said general-purpose processor and said dedicated tone generating device should execute the tone synthesizing processing based on the event; and a third step of, when said second step indicates that the tone synthesizing processing based on the event of the performance information received by said first step should be executed by said dedicated tone generating device, ascertaining whether or not said dedicated tone generating device is optionally provided, and outputting the performance information including the event via a predetermined output terminal when it is ascertained that said dedicated tone generating device is not provided.

17. A tone synthesizing apparatus as recited in claim 3 wherein said control device delays timing of instructing said dedicated tone generating device to execute the tone synthesizing processing, by delaying issuance of a command instructing said dedicated tone generating device to initiate tone generation, and wherein when said control device is to instruct said dedicated tone generating device to initiate tone generation, said control device issues the command instructing said dedicated tone generating device to initiate tone generation after said general-purpose processor completes the tone synthesizing processing for the plurality of samples for the plurality of channels.

18. A tone synthesizing apparatus comprising:

a receiving device adapted to receive performance information having a plurality of musical events;

a general-purpose processor which is capable of executing tone synthesizing processing;

a dedicated tone generating device which executes tone synthesizing processing; and a control device which, for each of the events of the performance information received by said receiving device, instructs at least one of said general-purpose processor and said dedicated tone generating device to execute the tone synthesizing processing based on the event, wherein said general-purpose processor collectively executes the tone synthesizing processing for a plurality of samples of each individual tone to be synthesized by said general-purpose processor, and wherein when said control device is to instruct said dedicated tone generating device to execute the tone synthesizing processing based on the event, said control device delays timing for instructing said dedicated tone generating device, by an amount corresponding to a time delay in the tone synthesizing processing by said general-purpose processor.

19. A method of synthesizing a tone by use of a general-purpose processor which is capable of executing tone synthesizing processing and a dedicated tone generating device which executes tone synthesizing processing, said method comprising:

a first step of receiving performance information having a plurality of musical events; and a second step of, for each of the events of the performance information received during said first step, instructing at least one of said general-purpose processor and said dedicated tone generating device to execute the tone synthesizing processing based on the event;

wherein, when said general-purpose processor is instructed in said second step, said general-purpose processor collectively executes the tone synthesizing processing for a plurality of samples of each individual tone to be synthesized by said general-purpose processor, and wherein, when said dedicated tone generating device is instructed in said second step, said dedicated tone generating device executes the tone synthesizing processing based on the event, and timing of the instructing of said dedicated tone generating device is delayed by an amount corresponding to a time delay in the tone synthesizing processing by said general-purpose processor.

20. A machine-readable medium containing a group of instructions of a program for synthesizing a tone by use of a general-purpose processor which is capable of executing tone synthesizing processing and a dedicated tone generating device which executes tone synthesizing processing, said medium causing a machine to perform the steps of:

a first step of receiving performance information having a plurality of musical events; and a second step of, for each of the events of the performance information received during said first step, instructing at least one of said general-purpose processor and said dedicated tone generating device to execute the tone synthesizing processing based on the event;

wherein, when said general-purpose processor is instructed in said second step, said general-purpose processor collectively executes the tone synthesizing processing for a plurality of samples of each individual tone to be synthesized by said general-purpose processor, and wherein, when said dedicated tone generating device is instructed in said second step, said dedicated tone generating device executes the tone synthesizing processing based on the event, and timing of the instructing of said dedicated tone generating device is delayed by an amount corresponding to a time delay in the tone synthesizing processing by said general-purpose processor.

21. A tone synthesizing apparatus comprising:

a receiving device adapted to receive performance information having a plurality of musical events;

a general-purpose processor which is capable of executing tone synthesizing processing;

a dedicated tone generating device which executes tone synthesizing processing; and a control device which, for each of the events of the performance information received by said receiving device, instructs at least one of said general-purpose processor and said dedicated tone generating device to execute the tone synthesizing processing based on the event, wherein the tone synthesizing processing by said general-purpose processor involves a certain time delay between a time point when said general-purpose processor has been instructed to execute the tone synthesizing processing by said control device and a time point when a start of generation of a tone synthesized by said tone synthesizing processing executed by said general-purpose processor becomes effective, and wherein when said control device is to instruct said dedicated tone generating device to execute the tone synthesizing processing based on the event, said control device delays timing for instructing said dedicated tone generating device, by an amount corresponding to said time delay in the tone synthesizing processing by said general-purpose processor.

22. A method of synthesizing a tone by use of a general-purpose processor which is capable of executing tone synthesizing processing and a dedicated tone generating device which executes tone synthesizing processing, said method comprising:

a first step of receiving performance information having a plurality of musical events; and a second step of, for each of the events of the performance information received, instructing at least one of said general-purpose processor and said dedicated tone generating device to execute the tone synthesizing processing based on the event, wherein, when said general-purpose processor is instructed in said second step, the tone synthesizing processing by said general-purpose processor involves a certain time delay between a time point when said general-purpose processor has been instructed to execute the tone synthesizing processing and a time point when a start of generation of a tone synthesized by said tone synthesizing processing executed by said general-purpose processor becomes effective, and wherein, when said dedicated tone generating device is instructed in said second step, said dedicated tone generating device is further instructed to execute the tone synthesizing processing based on the event, and timing for the instructing of said dedicated tone generating device is delayed by an amount corresponding to said time delay in the tone synthesizing processing by said general-purpose processor.

23. A machine-readable medium containing a group of instructions of a program for synthesizing a tone by use of a general-purpose processor which is capable of executing tone synthesizing processing and a dedicated tone generating device which executes tone synthesizing processing, said medium causing a machine to perform the steps of:

a first step of receiving performance information having a plurality of musical events; and a second step of, for each of the events of the performance information received, instructing at least one of said general-purpose processor and said dedicated tone generating device to execute the tone synthesizing processing based on the event, wherein, when said general-purpose processor is instructed in said second step, the tone synthesizing processing by said general-purpose processor involves a certain time delay between a time point when said general-purpose processor has been instructed to execute the tone synthesizing processing and a time point when a start of generation of a tone synthesized by said tone synthesizing processing executed by said general-purpose processor becomes effective, and wherein, when said dedicated tone generating device is instructed in said second step, said dedicated tone generating device is further instructed to execute the tone synthesizing processing based on the event, and timing for the instructing of said dedicated tone generating device is delayed by an amount corresponding to said time delay in the tone synthesizing processing by said general-purpose processor.

* * * * *